US009671706B2

(12) United States Patent
Nii et al.

(10) Patent No.: US 9,671,706 B2
(45) Date of Patent: Jun. 6, 2017

(54) ELECTROPHOTOGRAPHIC PHOTOCONDUCTOR, IMAGE FORMING APPARATUS, AND PROCESS CARTRIDGE

(71) Applicants: Daisuke Nii, Shizuoka (JP); Eiji Kurimoto, Shizuoka (JP); Tetsuro Suzuki, Shizuoka (JP); Tomoharu Asano, Kanagawa (JP); Toshihiro Ishida, Shizuoka (JP)

(72) Inventors: Daisuke Nii, Shizuoka (JP); Eiji Kurimoto, Shizuoka (JP); Tetsuro Suzuki, Shizuoka (JP); Tomoharu Asano, Kanagawa (JP); Toshihiro Ishida, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/669,115

(22) Filed: Mar. 26, 2015

(65) Prior Publication Data

US 2015/0309430 A1 Oct. 29, 2015

(30) Foreign Application Priority Data

Apr. 25, 2014 (JP) ..... 2014-091441

(51) Int. Cl.
*G03G 5/14* (2006.01)

(52) U.S. Cl.
CPC ..... *G03G 5/144* (2013.01); *G03G 5/142* (2013.01)

(58) Field of Classification Search
CPC ..... G03G 5/14; G03G 5/144
See application file for complete search history.

(56) References Cited

U.S. PATENT DOCUMENTS

| | | | | |
|---|---|---|---|---|
| 4,822,705 | A | 4/1989 | Fukagai et al. | |
| 2006/0014093 | A1 | 1/2006 | Li et al. | |
| 2010/0248105 | A1* | 9/2010 | Nukada ..... | G03G 5/14704 430/66 |

FOREIGN PATENT DOCUMENTS

| | | |
|---|---|---|
| JP | 63-206761 | 8/1988 |
| JP | 6-148923 | 5/1994 |
| JP | 2002-099107 | 4/2002 |

(Continued)

OTHER PUBLICATIONS

U.S. Appl. No. 14/558,061, filed Dec. 2, 2014.

*Primary Examiner* — Peter Vajda
(74) *Attorney, Agent, or Firm* — Oblon, McClelland, Maier & Neustadt, L.L.P.

(57) ABSTRACT

An electrophotographic photoconductor including a support, an undercoat layer overlying the support, and a photosensitive layer overlying the undercoat layer is provided. The undercoat layer includes zinc oxide particles and a binder resin. The undercoat layer has a voltage (V)-current (I) characteristics such that, when S1 is a value obtained by integrating current (I [A]) in terms of voltage (V [V]) from 0 to a distribution voltage $V_{UL}$ [V] distributed to the undercoat layer, and S2 is a value obtained by integrating a line connecting two points at a voltage (V [V]) of 0 and the distribution voltage $V_{UL}$ [V] in terms of voltage (V [V]) from 0 to the distribution voltage $V_{UL}$ [V], S1 is within a range of from $1.0\times10^{-4}$ to $1.0\times10^{-2}$ and a ratio (S1/S2) of S1 to S2 is 0.50 or less.

15 Claims, 5 Drawing Sheets

(56) References Cited

FOREIGN PATENT DOCUMENTS

| | | |
|---|---|---|
| JP | 2006-267954 | 10/2006 |
| JP | 2009-075341 | 4/2009 |
| JP | 2010-152099 | 7/2010 |
| JP | 2011-095476 | 5/2011 |
| JP | 2013-072986 | 4/2013 |

* cited by examiner

ELECTROPHOTOGRAPHIC PHOTOCONDUCTOR, IMAGE FORMING APPARATUS, AND PROCESS CARTRIDGE

CROSS-REFERENCE TO RELATED APPLICATIONS

This patent application is based on and claims priority pursuant to 35 U.S.C. §119(a) to Japanese Patent Application No. 2014-091441, filed on Apr. 25, 2014, in the Japan Patent Office, the entire disclosure of which is hereby incorporated by reference herein.

BACKGROUND

Technical Field

The present disclosure relates to an electrophotographic photoconductor, and an image forming apparatus and a process cartridge using the electrophotographic photoconductor.

Description of the Related Art

In an image forming method performed by an electrophotographic image forming apparatus, an image is formed by exposing an electrophotographic photoconductor (hereinafter may be referred to as "photoconductor", "electrostatic latent image bearer", or "latent image bearer") to the processes of charging, irradiation, developing, transfer, etc. Nowadays, organic photoconductors (OPC) that use organic materials are widely used as the electrophotographic photoconductor in terms of their flexibility, thermal stability, and film formation property.

Among various types of organic photoconductors, function-separated multi-layer photoconductors are now the mainstream, which have a charge generation layer containing a charge generation material and a charge transport layer containing a charge transport material each stacked on a support. The charge generation layer and charge transport layer serve as photosensitive layers. In particular, a number of negatively-chargeable photoconductors have been proposed which have a charge generation layer containing an organic pigment as a charge generation material and a charge transport layer containing an organic low-molecular-weight compound as a charge transport material. A technique of providing an undercoat layer between a support and a photosensitive layer has also been proposed for the purpose of suppressing charge injection from the support.

The organic photoconductors are required to have much higher durability and stability in accordance with the rapid progress of image forming apparatus technologies in terms of colorization, speeding up, and higher definition. On the other hand, through repeated exposure to the charging and neutralization processes in electrophotography, the organic materials contained in the organic photoconductor will gradually denature to cause deterioration in electrophotographic properties. As a result, charge trapping or charge property change will occur in the layers.

Such deterioration in electrophotographic properties caused by repeated use of the organic photoconductor largely affects the quality of the output images. For example, decrease in image density, background fog, residual image, and/or non-homogeneous image after continuous printing may be caused.

One factor that causes such deterioration in electrophotographic properties is considered deterioration of the undercoat layer. Generally, the undercoat layer is required to have the following two functions constantly: a function of preventing charge injection from the support into the photosensitive layer (hereinafter "charge injection prevention function") and a function of transporting charges generated in the photosensitive layer to the support (hereinafter "charge transport function"). The charge injection prevention function and charge transport function have a large influence on charging characteristics and optical attenuation characteristics of the photoconductor, respectively. Because these two functions are contradictory, it is very difficult to achieve a good balance therebetween.

SUMMARY

In accordance with some embodiments of the present invention, an electrophotographic photoconductor is provided. The electrophotographic photoconductor includes a support, an undercoat layer overlying the support, and a photosensitive layer overlying the undercoat layer. The undercoat layer includes zinc oxide particles and a binder resin. The undercoat layer has a voltage (V)-current (I) characteristics such that, when S1 is a value obtained by integrating current (I [A]) in terms of voltage (V [V]) from 0 to a distribution voltage $V_{UL}$ [V] distributed to the undercoat layer, and S2 is a value obtained by integrating a line connecting two points at a voltage (V [V]) of 0 and the distribution voltage $V_{UL}$ [V] in terms of voltage (V [V]) from 0 to the distribution voltage $V_{UL}$ [V], S1 is within a range of from $1.0\times10^{-4}$ to $1.0\times10^{-2}$ and a ratio (S1/S2) of S1 to S2 is 0.50 or less.

In accordance with some embodiments of the present invention, an image forming apparatus is provided. The image forming apparatus includes the above electrophotographic photoconductor, a charger, an irradiator, a developing device, and a transfer device. The charger charges a surface of the electrophotographic photoconductor. The irradiator irradiates the charged surface of the electrophotographic photoconductor with light to form an electrostatic latent image thereon. The developing device develops the electrostatic latent image into a visible image with toner. The transfer device transfers the visible image onto a recording medium.

In accordance with some embodiments of the present invention, a process cartridge detachably mountable on image forming apparatus is provided. The process cartridge includes the above electrophotographic photoconductor and at least one of the above charger, irradiator, developing device, and transfer device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
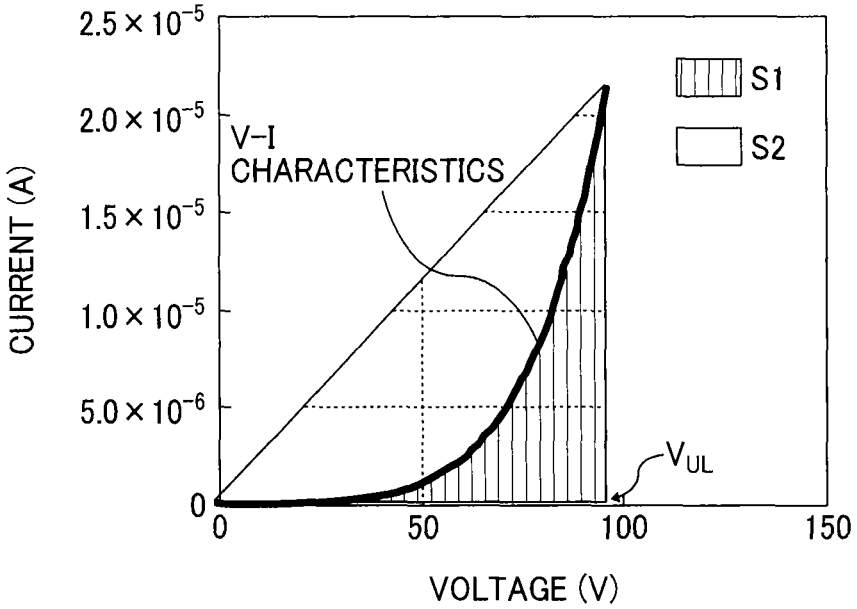
FIG. 1 is a graph showing an example of voltage (V)-current (I) characteristics.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

Within the context of the present disclosure, if a first layer is stated to be "overlaid" on, or "overlying" a second layer, the first layer may be in direct contact with a portion or all of the second layer, or there may be one or more intervening layers between the first and second layer, with the second layer being closer to the substrate than the first layer.

One proposed approach for achieving a good balance between the two functions, i.e., the charge injection prevention function and charge transport function, involves giving non-linearity to a voltage (V)-current (I) characteristics of the undercoat layer. In this approach, at the time of charging, the undercoat layer expresses a high electric resistance. Thus, positive charge injection from the support is prevented to allow a high level of charging. By contrast, at the time of light emission, the undercoat layer expresses a low electric resistance under the influence of a high electric field. Thus, it is possible to cause potential decay by negative charge transportation. It is said that a good balance can be achieved between charging characteristics and optical attenuation characteristics even after repeated use.

However, giving non-linearity to the voltage (V)-current (I) characteristics of the undercoat layer does not always lead to achievement of a good balance between charging characteristics and optical attenuation characteristics and maintenance thereof.

Not all negative charges generated in the photosensitive layer upon light emission and transported through the undercoat layer reach the support at the same speed. Each negative charge reaches the support at a different point in time. The electric field that influences the negative charges will decrease in strength as the charges generated in the photosensitive layer cause the surface charges to disappear. Accordingly, negative charges reaching the support earlier and those reaching the support later are influenced by different electric fields. Thus, the optical attenuation characteristics should be taken into consideration in view of charge flowability (i.e., current) not only in a high-strength electric field but also in various electric fields having various strengths.

Even when the undercoat layer has a non-linear voltage (V)-current (I) characteristics, if the total amount of current in all the electric fields is too small, there is a possibility that charge transportation becomes insufficient even upon emission of light, charge trapping in the undercoat layer increases to increase residual potential, and residual image is generated, through repeated use of the organic photoconductor.

Even when the undercoat layer has a non-linear voltage (V)-current (I) characteristics, if the total amount of current is too large, there is a possibility that positive charge injection cannot be sufficiently prevented and defective charging is caused, resulting in background fog, through repeated use of the organic photoconductor.

The above-described problems have not been recognized so far. No organic photoconductor has solved the problem of deterioration in charging characteristics and optical attenuation characteristics that cause background fog and residual image, respectively, after a long period of use.

Accordingly, an electrophotographic photoconductor which can prevent deterioration in charging characteristics and optical attenuation characteristics that cause background fog and residual image, respectively, even after a long period of use is demanded.

One object of the present invention is to provide an electrophotographic photoconductor which can prevent deterioration in charging characteristics and optical attenuation characteristics that cause background fog and residual image, respectively, even after a long period of use.

In accordance with some embodiments of the present invention, an electrophotographic photoconductor which can prevent deterioration in charging characteristics and optical attenuation characteristics that cause background fog and residual image, respectively, even after a long period of use is provided.

Electrophotographic Photoconductor

The electrophotographic photoconductor according to an embodiment of the present invention includes at least a support, an undercoat layer overlying the support, and a photosensitive layer overlying the undercoat layer, and optionally other layers, if necessary.

Support

The support is not limited to any particular material so long as it is a conductive body having a volume resistivity of $1\times10^{10}$ Ω·cm or less. For example, endless belts (e.g., an endless nickel belt, an endless stainless-steel belt) disclosed in JP-S52-36016-B can be used as the support.

The support can be formed by, for example, covering a support body (e.g., a plastic film, a plastic cylinder, a paper sheet) with a metal (e.g., aluminum, nickel, chromium, nichrome, copper, gold, silver, platinum) or a metal oxide (e.g., tin oxide, and indium oxide) by means of vapor deposition or sputtering; or subjecting a plate of a metal (e.g., aluminum, aluminum alloy, nickel, stainless steel) to an extruding or drawing process and then subjecting the resulting tube to a surface treatment (e.g., cutting, super finishing, polishing).

The support may have a conductive layer on its surface.

The conductive layer can be formed by, for example, applying a coating liquid, obtained by dispersing or dissolving a conductive powder and a binder resin in a solvent, to the support; or using a heat-shrinkable tube which is dispersing a conductive powder in a material such as polyvinyl chloride, polypropylene, polyester, polystyrene, polyvinylidene chloride, polyethylene, chlorinated rubber, and TEFLON (trademark).

Specific examples of the conductive powder include, but are not limited to, carbon particles such as carbon black and acetylene black; powders of metals such as aluminum, nickel, iron, nichrome, copper, zinc, and silver; and powders of metal oxides such as conductive tin oxide and ITO.

Specific examples of the binder resin for use in the conductive layer include, but are not limited to, thermoplastic, thermosetting, and photo-curable resins, such as polystyrene resin, styrene-acrylonitrile copolymer, styrene-butadiene copolymer, styrene-maleic anhydride copolymer, polyester resin, polyvinyl chloride resin, vinyl chloride-vinyl acetate copolymer, polyvinyl acetate resin, polyvinylidene chloride resin, polyarylate resin, phenoxy resin, polycarbonate resin, cellulose acetate resin, ethyl cellulose resin, polyvinyl butyral resin, polyvinyl formal resin, polyvinyl toluene resin, poly-N-vinylcarbazole, acrylic resin, silicone resin, epoxy resin, melamine resin, urethane resin, phenol resin, and alkyd resin. Two or more of these resins can be used in combination.

Specific examples of the solvent for use in forming the conductive layer include, but are not limited to, tetrahydrofuran, dichloromethane, methyl ethyl ketone, and toluene.

Undercoat Layer

The undercoat layer includes at least zinc oxide particles and a binder resin, and optionally other components, if necessary.

Preferably, the undercoat layer has a function that suppresses injection of unnecessary charges (i.e., charges having a polarity opposite to the charging polarity of the photoconductor) from the support into the photosensitive layer, and another function that transports charges generated in the photosensitive layer which have the same polarity as the charging polarity of the photoconductor. For example, in a case in which the photoconductor is negatively charged in the image forming process, the undercoat layer preferably has a function that prevents injection of positive holes from the support into the photosensitive layer (hereinafter "hole blocking property"), and another function that transports electrons from the photosensitive layer to the support (hereinafter "electron transportability"). In a photoconductor which is stable for an extended period of time, these properties will not change even after repeated exposure to electrostatic loads.

Zinc Oxide Particles

The zinc oxide particles preferably have an average particle diameter of from 20 to 250 nm, more preferably from 20 to 200 nm, and most preferably from 50 to 150 nm. Under a condition that a mass ratio (F/R) of the zinc oxide particles (F) to the binder resin (R) is constant, as the average particle diameter of the zinc oxide particles becomes large, the number of the zinc oxide particles in the undercoat layer becomes small; and as the average particle diameter of the zinc oxide particles becomes small, the number of the zinc oxide particles in the undercoat layer becomes large. Accordingly, when the average particle diameter of the zinc oxide particles is too large, the number of the zinc oxide particles in the undercoat layer is too small and the distance between the particles is too large. In this case, it is difficult for negative charges generated in a charge generation layer (CGL) to reach the support. As a result, charge trapping is likely to occur, causing abnormal images such as residual image. When the average particle diameter of the zinc oxide particles is too small, the number of the zinc oxide particles in the undercoat layer is too large. As a result, charge leakage is likely to occur, causing background fog.

The average particle diameter of the zinc oxide particles can be determined by observing 100 randomly-selected particles in the undercoat layer with a transmission electron microscope (TEM), measuring the projected areas of the particles, calculating circle-equivalent diameters of the projected areas, and averaging them.

The zinc oxide particles preferably have a powder resistivity (i.e., volume resistivity) of from $10^2$ to $10^{13}$ Ω·m. When the powder resistivity is too low, the undercoat layer will not be given a sufficient resistance to leakage, causing abnormal images such as background fog. When the powder resistivity is too high, charges will not be sufficiently transported from the photosensitive layer to the support, causing an increase in residual potential.

The volume resistivity of the zinc oxide particles can be measured by a known method such as a two-terminal method, a four-terminal method, and a four-point probe method.

The zinc oxide particles can be prepared by any known method, but is preferably prepared by a wet method.

The wet method is roughly of two types:

(1) A method that involves neutralizing an aqueous solution of zinc sulfate or zinc chloride with a soda ash solution to produce zinc carbonate, and water-washing, drying, and burning the zinc carbonate.

(2) A method that involves producing zinc hydroxide, and water-washing, drying, and burning the zinc hydroxide.

More specifically, in the wet method, first, a precipitate is produced from an aqueous zinc solution and an alkaline aqueous solution. The precipitate is then subjected to aging, washing, wetting with an alcohol, and drying, to obtain precursors of zinc oxide particles. The precursors of zinc oxide particles are burnt to obtain zinc oxide particles.

Specific examples of zinc compounds usable for preparing the aqueous zinc solution include, but are not limited to, zinc nitrate, zinc chloride, zinc acetate, and zinc sulfate.

Specific examples of the alkaline aqueous solution include, but are not limited to, aqueous solutions of sodium hydroxide, potassium hydroxide, ammonium hydrogen carbonate, and ammonia.

The precipitate is produced by dropping the aqueous solution of the zinc compound into the alkaline aqueous solution which is being stirred continuously.

Upon dropping of the aqueous solution of the zinc compound into the alkaline aqueous solution, the mixed solution immediately becomes supersaturated and a precipitation is caused. Specifically, particles of zinc carbonate and zinc carbonate hydroxide become precipitated with a uniform particle diameter.

It is difficult to precipitate such particles of zinc carbonate and zinc carbonate hydroxide with a uniform particle diameter when the alkaline aqueous solution is dropped into the aqueous solution of the zinc compound, or the aqueous solution of the zinc compound and the alkaline aqueous solution are dropped in parallel with each other.

At the time of precipitation, the alkaline aqueous solution preferably has a temperature of 50° C. or less, and more preferably room temperature (25° C.). There is no lower limit on the temperature of the alkaline aqueous solution. However, if the temperature is too low, a cooling equipment is necessary. Thus, the alkaline aqueous solution is preferably adjusted to have a temperature which does not need any cooling equipment.

The time period during which the aqueous solution of the zinc compound is dropped into the alkaline aqueous solution is preferably 30 minutes or less, more preferably 20 minutes or less, and most preferably 10 minutes or less, in terms of productivity.

After termination of the dropping, the system is subjected to an aging while being continuously stirred for the purpose of homogenization.

The temperature at the aging is same as that at the precipitation.

The time period for the continuous stirring is preferably 30 minutes or less, more preferably 15 minutes or less, in terms of productivity.

The precipitate obtained after the aging is washed by decantation. It is possible to adjust the amount of residual sulfate ions in the particles by adjusting the conductivity of the washings. This makes it possible to control the contents of sodium, calcium, and sulfur in the resulting zinc oxide particles.

The washed precipitate is subjected to a wetting treatment with an alcohol solution. The wetting treatment product is then dried to obtain precursors of zinc oxide particles. Owing to the wetting treatment, the precursors of zinc oxide particles are prevented from aggregating.

The alcohol solution preferably has an alcohol concentration of 50% by mass or more. When the alcohol concentration is 50% by mass or more, the zinc oxide particles are prevented from strongly aggregating and exert excellent dispersibility.

Preferably, the alcohol solution contains a water-soluble alcohol having a boiling point of 100° C. or less. Specific examples of such an alcohol include, but are not limited to, methanol, ethanol, propanol, and tert-butyl alcohol.

The wetting treatment is performed by pouring and stirring the filter-washed precipitate in the alcohol solution. The time for this treatment and stirring speed are determined depending on the amount of the precipitate to be treated.

The amount of the alcohol solution in which the precipitate is poured is that enough for easily stirring the precipitate and ensuring its fluidity.

The stirring time and speed are determined so that a part of the precipitate which has aggregated in the process of filter washing can be released and uniformly mixed.

The wetting treatment is generally performed at room temperature. The wetting treatment can also be performed on heating, if necessary, to the extent that the alcohol does not evaporate to disappear. Preferably, the heating temperature is equal to or less than the boiling point of the alcohol, so as to prevent disappearance of the alcohol during the wetting treatment and not to lose the effect of the wetting treatment.

Owing to the existence of the alcohol during the wetting treatment, the wetting treatment effectively works to prevent the dried precipitate from strongly aggregating.

Drying temperature and time for the wetting treatment product are not limited to any particular conditions. For example, the wetting treatment product that is wetted with the alcohol can be subjected to heat drying.

After the wetting treatment, the precipitate never forms strong aggregate even under heat drying. Accordingly, the drying conditions may be determined depending on the amount of the wetting treatment product and the type of treatment equipment.

As a result of the drying treatment, precursors of zinc oxide particles having been subjected to the wetting treatment are obtained. The precursors of zinc oxide particles are then burnt to obtain zinc oxide particles.

The precursors of zinc oxide particles obtained by the drying treatment are subjected to a burning. Preferably, the burning is performed in the air, an inert gas (e.g., nitrogen, argon, helium), or a mixed gas of the inert gas with a reducible gas (e.g., hydrogen).

The lower limit of the burning temperature is preferably about 400° C. in view of a desired ultraviolet ray absorbing (shielding) property.

The burning time is determined depending on the amount of the precursors of zinc oxide particles to be treated and/or the burning temperature.

Preferably, the undercoat layer contains surface-treated zinc oxide particles. Two or more types of zinc oxide particles, having different surface treatments or average particle diameters, can be used in combination.

Specific examples of surface treatment agents for the zinc oxide particles include, but are not limited to, a silane coupling agent, a titanate coupling agent, an aluminum coupling agent, and a surfactant. In particular, a silane coupling agent is preferable because it can give excellent electrophotographic property. More specifically, a silane coupling agent having an amino group is preferable because it can give excellent blocking property to the undercoat layer.

Specific examples of the silane coupling agent having an amino group include, but are not limited to, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, which can give desired electrophotographic properties. Two or more of these materials can be used in combination.

Specific examples of a silane coupling agent which can be used in combination with the silane coupling agent having an amino group include, but are not limited to, vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilane. Two or more of these materials can be used in combination.

The surface treatment method includes, for example, a dry method and a wet method.

In the drying method, a silane coupling agent or an organic solvent solution thereof is dropped or sprayed into the zinc oxide particles being stirred with a large shearing force by a mixer, along with dried air or nitrogen gas in the case of the spraying. The dropping or spraying is preferably performed at a temperature equal to or less than the boiling point of the solvent. When the spraying is performed at a temperature above the boiling point of the solvent, the solvent will evaporate before a uniform stirring is achieved and the silane coupling agent will locally get hard, which is not preferable in terms of uniform surface treatment. After the dropping or spraying, a burning can be performed at 100° C. or more. The burning can be performed at any temperature for any period of time so long as desired electrophotographic properties can be obtained.

In the wet method, the zinc oxide particles are stirred and dispersed in a solvent with an ultrasonic disperser, sand mill, attritor, or ball mill, a silane coupling agent solution is further stirred and dispersed therein, and the solvent is removed. The solvent is removed by means of filtering or distilling. After the solvent has been removed, a burning can be performed at 100° C. or more. The burning can be performed at any temperature for any period of time so long as desired electrophotographic properties can be obtained.

In the wet method, it is possible to remove moisture from the zinc oxide particles before the surface treatment agent is added thereto. For example, moisture can be removed by stirring and heating the zinc oxide particles in a solvent used for the surface treatment, or by boiling the zinc oxide particles together with the solvent.

The zinc oxide particles (or the surface-treated zinc oxide particles) contained in the undercoat layer are detectable by general analytical means such as gas chromatography mass spectrometer (GCMS), time-of-flight mass spectrometer (TOF-SIMS), nuclear magnetic resonance (NMR), infrared spectrophotometer (IR), Raman spectrophotometer, and Auger spectroscopy (AES).

Binder Resin

The binder resin of the undercoat layer preferably includes a resin having a high resistance to organic solvents, in view of the application of the photosensitive layer, to be described in detail later, to the undercoat layer.

Specific examples of such a resin include, but are not limited to, a water-soluble resin such as polyvinyl alcohol, casein, and sodium polyacrylate; an alcohol-soluble resin such as copolymerized nylon and methoxymethylated nylon; and a curable resin which forms a three-dimensional network structure, such as polyurethane, melamine resin, phenol resin, alkyd-melamine resin, and epoxy resin. Two or more of these resins can be used in combination.

It is preferable that the addition of the binder resin is prior to the dispersion of the zinc oxide particles. When the binder resin is added after the zinc oxide particles have been dispersed, the zinc oxide particles may be damaged by an excessive force because no resin exists therebetween, causing abnormal image such as residual image. When the addition amount of the binder resin is too small, it is difficult to form a film in which the zinc oxide particles are well dispersed. When the addition amount of the binder resin is too large, good electron transport function may not be expressed.

A mass ratio (F/R) of the zinc oxide particles (F) to the binder resin (R) is preferably from 1/1 to 6/1, and more preferably from 3/1 to 5/1.

When the content of the zinc oxide particles is too small, the distance between the particles is too large. In this case, it is difficult for negative charges generated in a charge generation layer (CGL) to reach the support. As a result, charge trapping is likely to occur, causing abnormal images such as residual image. When the content of the zinc oxide particles is too large, charge leakage is likely to occur, causing background fog.

Other Components

The undercoat layer may include other components for the purpose of improving electric property, environmental stability, and image quality.

Specific examples of such components include, but are not limited to, an electron transport material, an electron transport pigment, a zirconium chelate compound, a titanium chelate compound, an aluminum chelate compound, a titanium alkoxide compound, an organic titanium compound, and a silane coupling agent. Two or more of these materials can be used in combination.

Specific examples of the electron transport material include, but are not limited to, quinone compounds such as chloranil and bromanil; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds; thiophene compounds; and diphenoquinone compounds such as 3,3',5,5'-tetra-t-butyldiphenoquinone.

Specific examples of the electron transport pigment include, but are not limited to, a polycondensed pigment and an azo pigment.

The above-described silane coupling agent for use in the surface treatment of the zinc oxide particles can also be used as an additive for the coating liquid. Specific examples of the silane coupling agent include, but are not limited to, vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilane.

Specific examples of the zirconium chelate compound include, but are not limited to, zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Specific examples of the titanium chelate compound include, but are not limited to, tetraisopropyl titanate, tetranormalbutyl titanate, butyl titanate dimer, tetra(2-ethylhexyl) titanate, titanium acetylacetonate, polytitanium acetylacetonate, titanium octyleneglycolate, titanium lactate ammonium salt, titanium lactate, titanium lactate ethyl ester, titanium triethanolaminate, and polyhydroxy titanium stearate.

Specific examples of the aluminum chelate compound include, but are not limited to, aluminum isopropylate, monobutoxyaluminum diisopropylate, aluminum butyrate, diethyl acetoacetate aluminum diisopropylate, and aluminum tris(ethyl acetoacetate).

The undercoat layer can be formed by dispersing the zinc oxide particles and the binder resin in a solvent and applying the resulting liquid to the support, followed by drying.

Specific examples of the solvent include, but are not limited to, an alcohol such as methanol, ethanol, propanol, and butanol; a ketone such as acetone, methyl ethyl ketone, methyl isobutyl ketone, and cyclohexanone; an ester such as ethyl acetate and butyl acetate; an ether such as tetrahydrofuran, dioxane, and propyl ether; a halogen-based solvent such as dichloromethane, dichloroethane, trichloroethane, and chlorobenzene; an aromatic solvent such as benzene, toluene, and xylene; and a cellosolve such as methyl cellosolve, ethyl cellosolve, and cellosolve acetate. Two or more of these solvents can be used in combination.

A method of dispersing the zinc oxide particles in the undercoat layer coating liquid is not limited to any particular method, and can be selected from known industrial methods. For example, one preferable method uses a vibration mill containing zirconia beads having a diameter of 0.5 mm as media while setting the media ratio (i.e., the volume ratio of the media to the amount of the undercoat layer coating liquid) to from 50% to 150%, dispersing temperature to 50° C., liquid viscosity of the coating liquid to from 70 to 90 mPa·s, and dispersing time to from 3 to 5 hours.

A method of applying the undercoat layer coating liquid is not limited to any particular method, and is determined depending on the viscosity of the undercoat layer coating liquid, a desired average thickness of the undercoat layer, etc. Specific examples of the application method include, but are not limited to, a dipping method, a spray coating method, a bead coating method, and a ring coating method.

The undercoat layer coating liquid having been applied can be heat-dried with an oven, etc., if necessary. The drying temperature is determined depending on the type of the solvent included in the undercoat layer coating liquid, and is preferably from 80° C. to 200° C. and more preferably from 100° C. to 150° C. The drying time is preferably from 10 to 60 minutes. When the drying temperature is too low, there is a possibility that the solvent remains in the resulting layer. When the drying temperature is too high, the organic materials may deteriorate and the undercoat layer cannot express its function.

The average thickness of the undercoat layer is determined depending on the desired electric properties or lifespan of the electrophotographic photoconductor, and is preferably not less than 0.5 μm and less than 15 μm.

When the average thickness of the undercoat layer is too small (i.e., the undercoat layer is too thin), charges having a polarity opposite to the charging polarity of the electrophotographic photoconductor will be injected from the support to the photosensitive layer, causing defective image having background fog. When the average thickness of the undercoat layer is too large (i.e., the undercoat layer is too thick), the optical attenuation characteristic may deteriorate to cause residual potential increase, or repetitive stability may deteriorate.

A distribution voltage ($V_{UL}$) that is a charged potential distributed to the undercoat layer can be determined as follows.

An electrophotographic photoconductor having the undercoat layer, charge generation layer, and charge transport layer can be replaced with a model in which three condensers are connected in series. When distribution voltages distributed to the undercoat layer, charge generation layer, and charge transport layer are identified as $V_{UL}$, $V_{CGL}$, and $V_{CTL}$, respectively; charges of the undercoat layer, charge generation layer, and charge transport layer are identified as $Q_{UL}$, $Q_{CGL}$, and $Q_{CTL}$, respectively; and capacitances of the undercoat layer, charge generation layer, and charge transport layer are identified as $C_{UL}$, $C_{CGL}$, and $C_{CTL}$, respectively, a charged potential $V_{OPC}$ of the electrophotographic photoconductor is represented by the following equation (1).

$$V_{OPC}=V_{UL}+V_{CGL}+V_{CTL}=Q_{UL}/C_{UL}+Q_{CGL}/C_{CGL}+QCT_L/CCT_L \quad (1)$$

Because the model is a closed circuit, the equation $Q_{UL}=Q_{CGL}=Q_{CTL}$ is satisfied. Accordingly, the equation (1) can be rewritten to the following equation (2). The equation (2) indicates that the charged potential $V_{OPC}$ of the electrophotographic photoconductor is distributed to each layer in accordance with the capacitance of each layer.

$$V_{OPC}=(1/C_{UL}+1/C_{CGL}+1/C_{CTL})\cdot Q_{UL} \quad (2)$$

Because the capacitance of the charge generation layer is extremely larger than that of the other layers, the distribution voltage distributed to the charge generation layer is nearly zero. Accordingly, the equation (2) can be rewritten to the following equation (3). The equation (3) indicates that the charged potential is substantially distributed to the undercoat layer and the charge transport layer.

$$V_{OPC}=(1/C_{UL}+1/C_{CTL})\cdot Q_{UL}=(1/C_{UL}+1/C_{CTL})\cdot C_{UL}\cdot V_{UL} \quad (3)$$

The equation (3) can be further rewritten to the following equation (4). The equation (4) calculates the distribution voltage $V_{UL}$ distributed to the undercoat layer upon application of the charged potential $V_{OPC}$.

$$V_{UL}=V_{OPC}\cdot C_{CTL}/(C_{UL}+C_{CTL}) \quad (4)$$

The distribution voltage $V_{UL}$ distributed to the undercoat layer is preferably from 50 to 150 V. When the distribution voltage $V_{UL}$ is too low, charges will not be sufficiently transported from the photosensitive layer to the support, causing an increase in residual potential after repeated use. When the distribution voltage $V_{UL}$ is too high, the undercoat layer will not be given a sufficient resistance to leakage, causing deterioration in charging characteristics after repeated use.

With respect to a voltage (V)-current (I) characteristics of the undercoat layer as illustrated in FIG. 1, when S1 is defined as a value obtained by integrating current (I [A]) in terms of voltage (V [V]) from 0 to the distribution voltage $V_{UL}$ [V] distributed to the undercoat layer, and S2 is defined as a value obtained by integrating a line connecting two points at a voltage (V [V]) of 0 and the distribution voltage $V_{UL}$ [V] in terms of voltage (V [V]) from 0 to the distribution voltage $V_{UL}$ [V], S1 is within a range of from $1.0\times10^{-4}$ to $1.0\times10^{-2}$.

When S1 is less than $1.0\times10^{-4}$, sufficient potential decay cannot occur and a good optical attenuation cannot be obtained. As a result, the resulting image may have a decreased image density and poor gradation. When S1 exceeds $1.0\times10^{-2}$, it is difficult to prevent positive charge injection from the support to the undercoat layer. As a result, the photoconductor is charged poorly and background fog may be caused.

In addition, a ratio (S1/S2) of S1 to S2 is 0.50 or less. When the ratio (S1/S2) exceeds 0.50, good charging characteristics and optical attenuation (sensitivity) characteristics cannot be obtained due to poor charging of the photoconductor caused by positive charge injection from the support and poor potential decay upon emission of light. As a result, abnormal images including background fog, a decreased image density, and poor gradation may be produced.

The distribution voltage $V_{UL}$ can be determined as follows. First, a measurement sample is prepared by forming the undercoat layer on the support, and another measurement sample is prepared by forming the charge transport layer on the support. These measurement samples are subjected to a measurement of capacitance ($C_{UL}$ and $C_{CTL}$) of the undercoat layer and charge transport layer, respectively, with an impedance analyzer (Model 1260 from Solartron Analytical). The measured values are plugged in the equation (4) to calculate $V_{UL}$.

The measurement sample prepared by forming the undercoat layer on the support is further subjected to a measurement of a voltage (V)-current (I) characteristics with a micro current meter (Model 8340A from Advantest Corporation). With respect to the V-I characteristics of the undercoat layer, S1 is obtained by integrating I in terms of V from 0 to $V_{UL}$, and S2 is obtained by integrating a line connecting two points at V of 0 and $V_{UL}$ in terms of V from 0 to $V_{UL}$.

Photosensitive Layer

The photosensitive layer may be either a multi-layer photosensitive layer or a single-layer photosensitive layer.

Single-Layer Photosensitive Layer

The single-layer photosensitive layer has both a charge generation function and a charge transport function.

The single-layer photosensitive layer includes at least a charge generation material, a charge transport material, and a binder resin, and optionally other components, if necessary.

Charge Generation Material

Specific examples of the charge generation material include, but are not limited to, those for use in the multi-layer photosensitive layer to be described later. The content of the charge generation material is preferably from 5 to 40 parts by mass based on 100 parts by mass of the binder resin.

Charge Transport Material

Specific examples of the charge transport material include, but are not limited to, those for use in the multi-layer photosensitive layer to be described later. The content of the charge transport material is preferably 190 parts by mass or less, more preferably from 50 to 150 parts by mass, based on 100 parts by mass of the binder resin.

Binder Resin

Specific examples of the binder resin include, but are not limited to, those for use in the multi-layer photosensitive layer to be described later.

Other Components

Specific examples of the other components include, but are not limited to, those for use in the multi-layer photosensitive layer to be described later, such as a low-molecular-weight charge transport material, a solvent, a leveling agent, and an antioxidant.

Method of Forming Single-Layer Photosensitive Layer

A method of forming the single-layer photosensitive layer may include, for example, dissolving or dispersing the charge generation material, charge transport material, binder resin, and other components in a solvent (e.g., tetrahydrofuran, dioxane, dichloroethane, cyclohexane) with a disperser to prepare a coating liquid, and applying and drying the coating liquid.

A method of applying the coating liquid may be, for example, a dipping method, a spray coating method, a bead coating method, or a ring coating method. The single-layer photosensitive layer may further include additives such as a plasticizer, a leveling agent, and an antioxidant, if necessary.

The average thickness of the single-layer photosensitive layer is preferably 50 μm or less, and more preferably 25 μm or less, in terms of resolution and responsiveness. The lower limit of the average thickness is preferably 5 μm or more, but it depends on the system (in particular, charge potential) in use.

Multi-Layer Photosensitive Layer

In the multi-layer photosensitive layer, a charge generation function and a charge transport function are provided from independent layers. Accordingly, the multi-layer photosensitive layer has a charge generation layer and a charge transport layer.

In the multi-layer photosensitive layer, the stacking sequence of the charge generation layer and charge transport layer is not limited. Generally, most charge generation materials are poor in chemical stability and cause deterioration in charge generation efficiency when exposed to an acid gas, such as a discharge product generated around a charger in an electrophotographic apparatus. Therefore, it is preferable that the charge transport layer is overlaid on the charge generation layer.

Charge Generation Layer

The charge generation layer includes at least a charge generation material and a binder resin, and optionally other components, if necessary.

Charge Generation Material

Specific examples of the charge generation material include, but are not limited to, an inorganic material and an organic material.

Inorganic Material

Specific examples of the inorganic material include, but are not limited to, crystalline selenium, amorphous selenium, selenium-tellurium compounds, selenium-tellurium-halogen compounds, selenium-arsenic compounds, and amorphous silicon (e.g., those in which dangling bonds are terminated with hydrogen atom, halogen atom, etc.; or doped with boron atom, phosphor atom, etc.).

Organic Material

Specific examples of the organic material include, but are not limited to, phthalocyanine pigments such as metal phthalocyanine and metal-free phthalocyanine; azulenium salt pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bis-stilbene skeleton, azo pigments having a distyryloxadiazole skeleton, azo pigments having a distyrylcarbazole skeleton, perylene pigments, anthraquinone or polycyclic quinone pigments, quinonimine pigments, diphenylmethane and triphenylmethane pigments, benzoquinone and naphthoquinone pigments, cyanine and azomethine pigments, indigoid pigments, and bisbenzimidazole pigments. Two or more of these materials can be used in combination.

Binder Resin

Specific examples of the binder resin include, but are not limited to, polyamide resin, polyurethane resin, epoxy resin, polyketone resin, polycarbonate resin, silicone resin, acrylic resin, polyvinyl butyral resin, polyvinyl formal resin, polyvinyl ketone resin, polystyrene resin, poly-N-vinylcarbazole resin, and polyacrylamide resin. Two or more of these resins can be used in combination.

Specific examples of the binder resin further include charge transport polymers having a charge transport function, such as polymers (e.g., polycarbonate, polyester, polyurethane, polyether, polysiloxane) having an aryl skeleton, a benzidine skeleton, a hydrazone skeleton, a carbazole skeleton, a stilbene skeleton, a pyrazoline skeleton, etc.; and polymers having a polysilane skeleton.

Other Components

Specific examples of the other components include, but are not limited to, a low-molecular-weight charge transport material, a solvent, a leveling agent, and an antioxidant.

The content of the other components is preferably form 0.01% to 10% by mass based on total mass of the layer.

Low-Molecular-Weight Charge Transport Material

Specific examples of the low-molecular-weight charge transport material include, but are not limited to, an electron transport material and a hole transport material.

Specific examples of the electron transport material include, but are not limited to, chloranil, bromanil, tetracyanoethylene, tetracyanoquinodimethane, 2,4,7-trinitro-9-fluorenon, 2,4,5,7-tetranitro-9-fluorenon, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide, and diphenoquinone derivatives. Two or more of these materials can be used in combination.

Specific examples of the hole transport material include, but are not limited to, oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, and enamine derivatives. Two or more of these materials can be used in combination.

Solvent

Specific examples of the solvent include, but are not limited to, tetrahydrofuran, dioxane, dioxolan, toluene, dichloromethane, monochlorobenzene, dichloroethane, cyclohexanone, cyclopentanone, anisole, xylene, methyl ethyl ketone, acetone, ethyl acetate, and butyl acetate. Two or more of these solvents can be used in combination.

Leveling Agent

Specific examples of the leveling agent include, but are not limited to, silicone oils such as dimethyl silicone oil and methyl phenyl silicone oil. Two or more of these materials can be used in combination.

Method of Forming Charge Generation Layer

A method of forming the charge generation layer may include, for example, dissolving or dispersing the charge generation material and the binder resin in the other component, such as the solvent, to prepare a coating liquid, applying the coating liquid on the support, and drying the coating liquid. The coating liquid can be applied by, for example, a casting method.

The average thickness of the charge generation layer is preferably from 0.01 to 5 μm, and more preferably from 0.1 to 2 μm.

Charge Transport Layer

The charge transport layer has a function of retaining charges and another function of transporting charges generated in the charge generation layer upon light exposure to make them bind the charges retained in the charge transport layer. In order to retain charges, the charge transport layer is required to have a high electric resistance. Additionally, in order to achieve a high surface potential with the retaining charges, the charge transport layer is required to have a small permittivity and good charge mobility.

The charge transport layer includes at least a charge transport material and a binder resin, and optionally other components, if necessary.

Charge Transport Material

Specific examples of the charge transport material include, but are not limited to, an electron transport material, a hole transport material, and a polymeric charge transport material.

The content of the charge transport material is preferably from 20% to 80% by mass, more preferably from 30% to 70% by mass, based on total mass of the charge transport layer. When the content is less than 20% by mass, the charge mobility in the charge transport layer is so small that a desired optical attenuation characteristic may not be obtained. When the content exceeds 80% by mass, the charge transport layer may become excessively worn by various hazards to which the photoconductor has been exposed in an image forming process. When the content of the charge transport material in the charge transport layer is within the above-described range, desired optical attenuation characteristics can be obtained with a smaller amount of wear of the photoconductor.

Electron Transport Material

Specific examples of the electron transport material (electron-accepting material) include, but are not limited to, chloranil, bromanil, tetracyanoethylene, tetracyanoquinodimethane, 2,4,7-trinitro-9-fluorenon, 2,4,5,7-tetranitro-9-fluorenon, 2,4,5,7-tetranitroxanthone, 2,4,8-trinitrothioxanthone, 2,6,8-trinitro-4H-indeno[1,2-b]thiophene-4-one, and 1,3,7-trinitrodibenzothiophene-5,5-dioxide. Two or more of these materials can be used in combination.

Hole Transport Material

Specific examples of the hole transport material (electron-donating material) include, but are not limited to, oxazole derivatives, oxadiazole derivatives, imidazole derivatives, triphenylamine derivatives, 9-(p-diethylaminostyrylanthracene), 1,1-bis-(4-dibenzylaminophenyl)propane, styrylanthracene, styrylpyrazoline, phenylhydrazone, α-phenylstilbene derivatives, thiazole derivatives, triazole derivatives, phenazine derivatives, acridine derivatives, benzofuran derivatives, benzimidazole derivatives, and thiophene derivatives. Two or more of these materials can be used in combination.

Polymeric Charge Transport Material

The polymeric charge transport material has both a function of binder resin and a function of charge transport material.

Specific examples of the polymeric charge transport material include, but are not limited to, polymers having a carbazole ring, polymers having a hydrazone structure, polysilylene polymers, polymers having a triarylamine structure (e.g., described in JP-3852812-B and JP-3990499-B), and polymers having an electron-donating group. Two or more of these materials can be used in combination. Below-described binder resins can also be used in combination for improving abrasion resistance and film formation property.

The content of the polymeric charge transport material is preferably from 40% to 90% by mass, more preferably from 50% to 80% by mass, based on total mass of the charge transport layer, when the polymeric charge transport material and the binder resin are used in combination.

Binder Resin

Specific examples of the binder resin include, but are not limited to, polycarbonate resin, polyester resin, methacrylic resin, acrylic resin, polyethylene resin, polyvinyl chloride resin, polyvinyl acetate resin, polystyrene resin, phenol resin, epoxy resin, polyurethane resin, polyvinylidene chloride resin, alkyd resin, silicone resin, polyvinyl carbazole resin, polyvinyl butyral resin, polyvinyl formal resin, polyacrylate resin, polyacrylamide resin, and phenoxy resin. Two or more of these resins can be used in combination.

The charge transport layer may further include a copolymer of a cross-linkable binder resin with a cross-linkable charge transport material.

Other Components

Specific examples of the other components include, but are not limited to, a solvent, a plasticizer, a leveling agent, and an antioxidant.

The content of the other components is preferably form 0.01% to 10% by mass based on total mass of the layer.

Solvent

Specific examples of the solvent include, but are not limited to, those usable for the charge generation layer. In particular, those capable of well dissolving the charge transport material and the binder resin are preferable. Two or more of such solvents can be used in combination.

Plasticizer

Specific examples of the plasticizer include, but are not limited to, dibutyl phthalate and dioctyl phthalate, which are general plasticizer for resins.

Leveling Agent

Specific examples of the leveling agent include, but are not limited to, silicone oils such as dimethyl silicone oil and methyl phenyl silicone oil; and polymers and oligomers having a perfluoroalkyl side chain.

Method of Forming Charge Transport Layer

A method of forming the charge transport layer may include, for example, dissolving or dispersing the charge transport material and the binder resin in the other component, such as the solvent, to prepare a coating liquid, applying the coating liquid on the charge generation layer, and heating or drying the coating liquid.

A method of applying the charge transport layer coating liquid is not limited to any particular method, and is determined depending on the viscosity of the coating liquid, a desired average thickness of the charge transport layer, etc. Specific examples of the application method include, but are not limited to, a dipping method, a spray coating method, a bead coating method, and a ring coating method.

In view of electrophotographic properties and film viscosity, the solvent should be removed from the charge transport layer by means of heating.

The heating may be performed by, for example, heating the charge transport layer from the coated surface side or the support side with heat energy such as a gas (e.g., the air, nitrogen), a vapor, a heat medium, infrared ray, and electromagnetic wave.

The heating temperature is preferably from 100° C. to 170° C. When the heating temperature is less than 100° C., the solvent cannot be completely removed from the layer, causing deterioration in electrophotographic properties and abrasion durability. When the heating temperature exceeds 170° C., orange-peel-like defects or cracks may appear on the surface, and the layer may detach from adjacent layers. Moreover, in a case in which volatile components in the photosensitive layer are atomized, desired electric properties cannot be obtained.

The average thickness of the charge transport layer is preferably from 5 to 40 μm, and more preferably from 10 to 30 μm, in terms of resolution and responsiveness.

Other Layers

Specific examples of the other layers include, but are not limited to, a protective layer and an intermediate layer.

Protective Layer

In accordance with some embodiments of the present invention, the electrophotographic photoconductor may have a protective layer overlying the photosensitive layer, for the purpose of protecting the photosensitive layer.

Specific examples of materials usable for the protective layer include, but are not limited to, ABS resin, ACS resin, olefin-vinyl monomer copolymer, chlorinated polyether, aryl resin, phenol resin, polyacetal, polyamide, polyamide-imide, polyacrylate, polyarylsulfone, polybutylene, polybutylene terephthalate, polycarbonate, polyethersulfone, polyethylene, polyethylene terephthalate, polyimide, acrylic resin, polymethylpentene, polypropylene, polyphenylene oxide, polysulfone, polystyrene, polyacrylate, AS resin, butadiene-styrene copolymer, polyurethane, polyvinyl chloride, polyvinylidene chloride, and epoxy resin. Two or more of these materials can be used in combination. Among these materials, polycarbonate and polyarylate are preferable in view of filler dispersibility, residual potential, and coated film defect.

The protective layer may include a filler for the purpose of improving abrasion resistance.

Specific examples of usable solvents for the protective layer coating liquid include, but are not limited to, those usable for the charge transport layer coating liquid, such as tetrahydrofuran, dioxane, toluene, dichloromethane, monochlorobenzene, dichloroethane, cyclohexanone, methyl ethyl ketone, and acetone. At the time of dispersing the coting liquid, a high-viscosity solvent is preferred. At the time of applying the coating liquid, a high-volatility solvent is preferred. If no solvent satisfies the above preferences, two or more types of solvents having different properties can be used in combination, which may have great effect on filler dispersibility and residual potential.

The average thickness of the protective layer is preferably 10 μm or less, and more preferably 8 μm or less. The lower limit of the average thickness is preferably 3 μm or more in terms of chargeability and abrasion durability, but it depends on the system (in particular, charge potential) in use.

Further adding the charge transport material used for the charge transport layer to the protective layer is advantageous for reducing residual potential and improving image quality.

A method of forming the protective layer may be, for example, a dipping method, a spray coating method, a bead coating method, a nozzle coating method, a spinner coating method, or a ring coating method. Among these methods, a spray coating method is preferable in view of its uniform film forming property.

Intermediate Layer

The intermediate layer can be provided between the charge transport layer and the protective layer, for the purpose of suppressing charge transport layer components being mixed into the protective layer or improving adhesiveness between the two layers.

The intermediate layer includes at least a binder resin, and optionally other components such as an antioxidant, if necessary. Preferably, the intermediate layer coating liquid is insoluble or poorly-soluble in the protective layer coating liquid.

Specific examples of the binder resin in the intermediate layer include, but are not limited to, polyamide, alcohol-soluble nylon, polyvinyl butyral, and polyvinyl alcohol.

The intermediate layer can be formed in the same manner as the photosensitive layer is formed.

The average thickness of the intermediate layer is preferably from 0.05 to 2 μm.

In accordance with some embodiments of the present invention, for the purpose of preventing sensitivity decrease and residual potential increase, the single-layer photosensitive layer, charge generation layer, charge transport layer, undercoat layer, and/or protective layer may include an antioxidant, a plasticizer, a lubricant, an ultraviolet ray absorber, a leveling agent, etc., if necessary. The contents of these additives are not limited and determined based on the purpose.

Electrophotographic Photoconductor

First Embodiment

Figure 2:
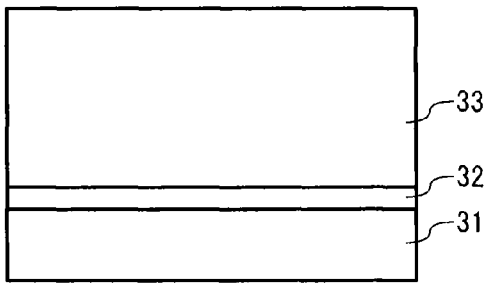
FIG. 2 is a schematic cross-sectional view of an electrophotographic photoconductor according to an embodiment of the present invention.

FIG. 2 is a schematic cross-sectional view of an electrophotographic photoconductor according to an embodiment of the present invention.

The electrophotographic photoconductor illustrated in FIG. 2 has a single-layer photosensitive layer. This electrophotographic photoconductor includes, from the innermost side thereof, a support 31, an undercoat layer 32 containing zinc oxide particles and a binder resin, and a single-layer photosensitive layer 33.

Second Embodiment

Figure 3:
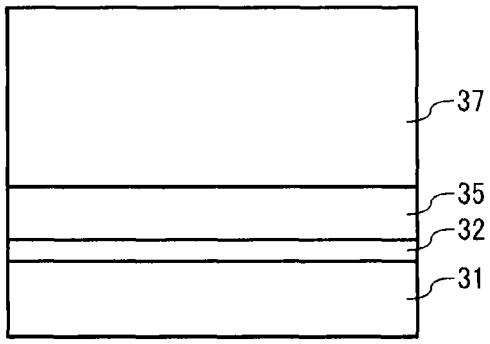
FIG. 3 is a schematic cross-sectional view of an electrophotographic photoconductor according to another embodiment of the present invention.

FIG. 3 is a schematic cross-sectional view of an electrophotographic photoconductor according to another embodiment of the present invention.

The electrophotographic photoconductor illustrated in FIG. 3 has a multi-layer photosensitive layer. This electrophotographic photoconductor includes, from the innermost side thereof, a support 31, an undercoat layer 32 containing zinc oxide particles and a binder resin, a charge generation layer 35, and a charge transport layer 37. The charge generation layer 35 and the charge transport layer 37 correspond to the photosensitive layer.

Third Embodiment

Figure 4:
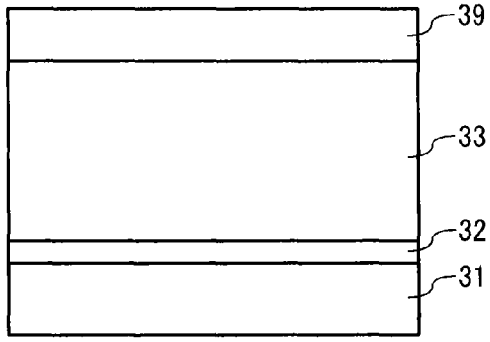
FIG. 4 is a schematic cross-sectional view of an electrophotographic photoconductor according to another embodiment of the present invention.

FIG. 4 is a schematic cross-sectional view of an electrophotographic photoconductor according to another embodiment of the present invention.

The electrophotographic photoconductor illustrated in FIG. 4 has a single-layer photosensitive layer. This electrophotographic photoconductor includes, from the innermost side thereof, a support 31, an undercoat layer 32 containing zinc oxide particles and a binder resin, a single-layer photosensitive layer 33, and a protective layer 39.

Fourth Embodiment

Figure 5:
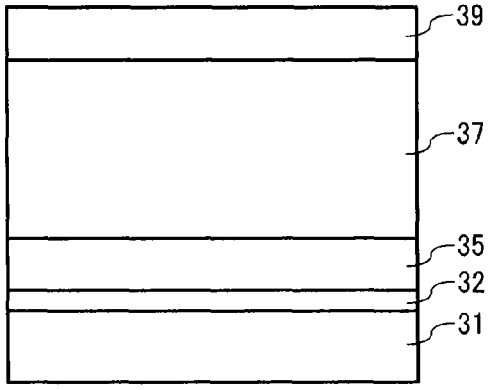
FIG. 5 is a schematic cross-sectional view of an electrophotographic photoconductor according to another embodiment of the present invention.

FIG. 5 is a schematic cross-sectional view of an electrophotographic photoconductor according to another embodiment of the present invention.

The electrophotographic photoconductor illustrated in FIG. 5 has a multi-layer photosensitive layer. This electrophotographic photoconductor includes, from the innermost side thereof, a support 31, an undercoat layer 32 containing zinc oxide particles and a binder resin, a charge generation layer 35, and a charge transport layer 37, and a protective layer 39. The charge generation layer 35 and the charge transport layer 37 correspond to the photosensitive layer.

Image Forming Apparatus and Image Forming Method

An image forming apparatus in accordance with some embodiments of the present invention includes at least the above-described electrophotographic photoconductor in accordance with some embodiments of the present invention, a charger, an irradiator, a developing device, and a transfer device, and optionally other devices, if necessary.

The charger and irradiator may be hereinafter collectively referred to as an electrostatic latent image forming device.

An image forming method in accordance with some embodiments of the present invention includes at least a charging process, an irradiation process, a developing process, and a transfer process, and optionally other processes, if necessary.

The image forming method used the above-described electrophotographic photoconductor in accordance with some embodiments of the present invention. The charging and irradiation processes may be hereinafter collectively referred to as an electrostatic latent image forming process.

Charger and Charging Process

The charging process is a process of charging a surface of the electrophotographic photoconductor. The charging process can be performed by the charger.

Specific examples of the charger include, but are not limited to, a contact charger equipped with a conductive or semiconductive roller, brush, film, or rubber blade, and a non-contact charger (including a proximity non-contact charger having a gap distance of 100 μm or less between a surface of the electrophotographic photoconductor and the charger) employing corona discharge such as corotron and scorotron.

Preferably, the charger has a charging member in contact with or proximity to a surface of the electrophotographic photoconductor, and is configured to apply a voltage in which an alternating current component is superimposed on a direct current component to the charging member to cause corona discharge between the charging member and the surface of the electrophotographic photoconductor.

Irradiator and Irradiation Process

The irradiation process is a process of irradiating the charged surface of the electrophotographic photoconductor with light to form an electrostatic latent image. The irradiating process can be performed by the irradiator.

The irradiator is not limited in configuration so long as it can irradiate the charged surface of the electrophotographic photoconductor with light containing image information. Specific examples of the irradiator include, but are not limited to, various irradiators of radiation optical system type, rod lens array type, laser optical type, liquid crystal shutter optical type, and LED optical system type. Specific examples of light sources for use in the irradiator include, but are not limited to, those providing a high luminance, such as light-emitting diode (LED), laser diode (LD), and electroluminescence (EL). The irradiation process can also be performed by irradiating the back surface of the electrophotographic photoconductor with light containing image information.

Developing Device and Developing Process

The developing process is a process of developing the electrostatic latent image into a visible image with toner. The developing process can be performed by the developing device.

The developing device is not limited in configuration so long as it can develop the electrostatic latent image with toner or developer. For example, a developing device capable of storing a developer and supplying the developer to the electrostatic latent image either by contact therewith or without contact therewith is preferable. The developing device may employ either a dry developing method or a wet developing method. The developing device may employ either a single-color developing device or a multi-color developing device. For example, a developing device which has a stirrer for frictionally charging the developer and a rotatable magnet roller is preferable. In the developing device, toner particles and carrier particles are mixed and stirred, and the toner particles are charged by friction. The charged toner particles and carrier particles are formed into ear-like aggregation and retained on the surface of the magnet roller that is rotating, thus forming a magnetic brush. Because the magnet roller is disposed adjacent to the electrophotographic photoconductor, part of the toner particles composing the magnetic brush formed on the surface of the magnet roller migrate to the surface of the electrophotographic photoconductor by an electric attractive force. As a result, the electrostatic latent image is developed with the toner particles to form a visible image on the surface of the electrophotographic photoconductor.

Transfer Device and Transfer Process

The transfer process is a process of transferring the visible image onto a recording medium. The transfer process can be performed by the transfer device.

The transfer device is a device for transferring the visible image onto a recording medium. The transfer device may employ either a direct transfer method which involves directly transferring the visible image from the surface of the electrophotographic photoconductor onto a recording medium, or a secondary transfer method which involves primarily transferring the visible image onto an intermediate transfer medium and secondarily transferring the visible image on a recording medium. In a case in which transfer process itself is considered to adversely affect image quality, the former (i.e., the direct direct method) is preferable because exposure to transfer processes is less frequent. The transfer process can be performed by transferring the visible image by charging the electrophotographic photoconductor by a transfer charger. The transfer process can be performed by the transfer device.

Other Devices and Other Processes

The other devices and other processes may include, for example, a fixing device and a fixing process; a neutralizer and a neutralization process; a cleaner and a cleaning process; a recycler and a recycle process; and a controller and a control process.

Fixing Device and Fixing Process

The fixing process is a process of fixing the transferred image on the recording medium. The fixing process can be performed by the fixing device.

The fixing device preferably includes a heat-pressure member. Specific examples of the heat-pressure member include, but are not limited to, a combination of a heat roller and a pressure roller; and a combination of a heat roller, a pressure roller, and an endless belt. The heating temperature is preferably from 80° C. to 200° C. The fixing process may be performed either every time each color toner image is transferred onto the recording medium or at once after all color toner images are superimposed on one another.

Neutralizer and Neutralization Process

The neutralization process is a process of neutralizing the electrophotographic photoconductor by application of a neutralization bias thereto. The neutralization process can be performed by the neutralizer.

The neutralizer is not limited in configuration so long as it can apply a neutralization bias to the electrophotographic photoconductor. Specific examples of the neutralizer include, but are not limited to, a neutralization lamp.

Cleaner and Cleaning Process

The cleaning process is a process of removing residual toner particles remaining on the electrophotographic photoconductor. The cleaning process can be performed by the cleaner.

The cleaner is not limited in configuration so long as it can remove residual toner particles remaining on the electrophotographic photoconductor. Specific examples of the cleaner include, but are not limited to, magnetic brush cleaner, electrostatic brush cleaner, magnetic roller cleaner, blade cleaner, brush cleaner, and web cleaner.

Recycler and Recycle Process

The recycle process is a process of recycling the toner particles removed in the cleaning process in the developing device. The recycle process can be performed by the recycler.

Specific examples of the recycler include, but are not limited to, a conveyer.

Controller and Control Process

The control process is a process of controlling the above-described processes. The control process can be performed by the controller.

The controller is not limited in configuration so long as it can control the above-described processes. Specific examples of the controller include, but are not limited to, a sequencer and a computer.

First Embodiment

Figure 6:
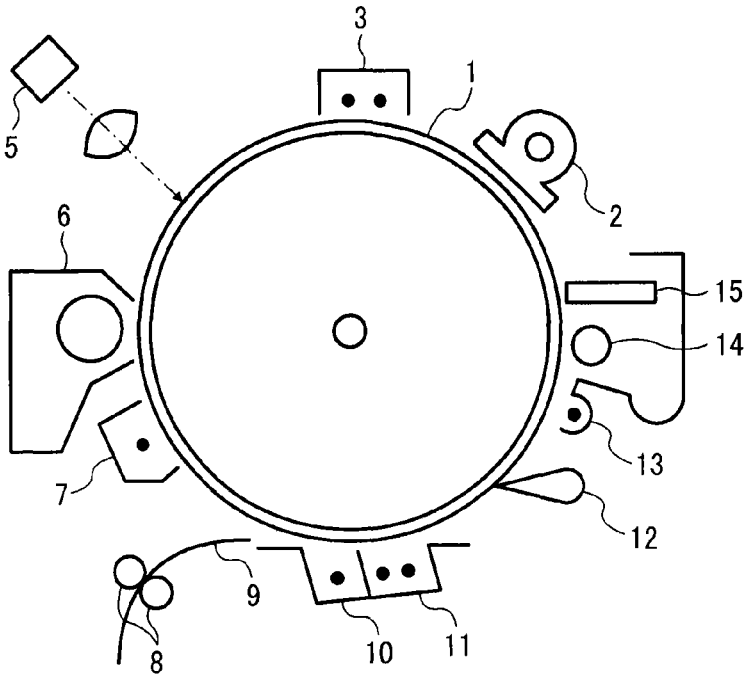
FIG. 6 is a schematic view of an image forming apparatus according an embodiment of the present invention.

FIG. 6 is a schematic view of an image forming apparatus according an embodiment of the present invention. The image forming apparatus includes an electrophotographic photoconductor 1; and a charger 3, an irradiator 5, a developing device 6, and a transfer device 10 disposed around the electrophotographic photoconductor 1. In FIG. 6, a numeral 8 denotes a pair of conveyance rollers.

First, the charger 3 uniformly charges the electrophotographic photoconductor 1. Specific examples of the charger 3 include, but are not limited to, a corotron device, a scorotron device, a solid-state discharging element, a needle electrode device, a roller charging device, and a conductive brush device.

Next, the irradiator 5 forms an electrostatic latent image on the uniformly-charged electrophotographic photoconductor 1. Specific examples of light sources for use in the irradiator 5 include, but are not limited to, all luminous matters such as fluorescent lamp, tungsten lamp, halogen lamp, mercury lamp, sodium-vapor lamp, light-emitting diode (LED), laser diode (LD), and electroluminescence (EL). For the purpose of emitting light having a desired wavelength only, any type of filter can be used such as sharp cut filter, band pass filter, near infrared cut filter, dichroic filter, interference filter, and color-temperature conversion filter.

Next, the developing device 6 develops the electrostatic latent image formed on the electrophotographic photoconductor 1 into a toner image that is visible. Developing method may be either a dry developing method using a dry toner, such as one-component developing method and two-component developing method; or a wet developing method using a wet toner. When the electrophotographic photoconductor 1 is positively (or negatively) charged and irradiated with light containing image information, a positive (or negative) electrostatic latent image is formed thereon. When the positive (or negative) electrostatic latent image is developed with a negative-polarity (or positive-polarity) toner, a positive image is produced. By contrast, when the positive (or negative) electrostatic latent image is developed with a positive-polarity (or negative-polarity) toner, a negative image is produced.

Next, the transfer device 10 transfers the toner image from the electrophotographic photoconductor 1 onto a recording medium 9. For the purpose of improving transfer efficiency, a pre-transfer charger 7 may be used. The transfer device 10 may employ an electrostatic transfer method that uses a transfer charger or a bias roller; a mechanical transfer method such as adhesive transfer method and pressure transfer method; or a magnetic transfer method.

As means for separating the recording medium 9 from the electrophotographic photoconductor 1, a separation charger 11 and a separation claw 12 may be used, if necessary. The separation may also be performed by means of electrostatic adsorption induction separation, side-end belt separation, leading-end grip conveyance, curvature separation, etc. As the separation charger 11, the above-described charger can be used. For the purpose of removing residual toner particles remaining on the electrophotographic photoconductor 1 without being transferred, cleaners such as a fur brush 14 and a cleaning blade 15 may be used. For the purpose of improving cleaning efficiency, a pre-cleaning charger 13 may be used. The cleaning may also be performed by a web-type cleaner, a magnetic-brush-type cleaner, etc. Such cleaners can be used alone or in combination. For the purpose of removing residual latent image on the electrophotographic photoconductor 1, a neutralizer 2 may be used. Specific examples of the neutralizer 2 include, but are not limited to, a neutralization lamp and a neutralization charger. As the neutralization lamp and the neutralization charger, the above-described light source and charger can be used, respectively. Processes which are performed not in the vicinity of the photoconductor, such as document reading, paper feeding, fixing, paper ejection, can be performed by known means.

Second Embodiment

Figure 7:
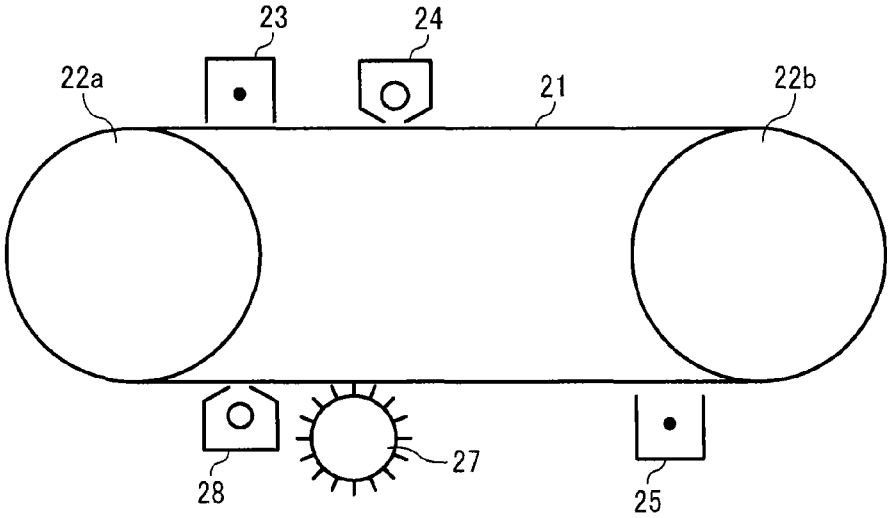
FIG. 7 is a schematic view of an electrophotographic image forming apparatus according to an embodiment of the present invention.

FIG. 7 is a schematic view of an electrophotographic image forming apparatus according to an embodiment of the present invention. A photoconductor 21 includes at least a photosensitive layer and an undercoat layer. The photoconductor 21 is driven by driving rollers 22*a* and 22*b*, and repeatedly exposed to the processes of charging by a charger 23, image irradiation by a light source 24, developing, transfer by a transfer charger 25, cleaning by a brush 27, and neutralization by a light source 28.

In addition to the light irradiation processes shown in FIG. 7, i.e., the processes of image irradiation, pre-cleaning irradiation, and neutralization irradiation, other light irradiation processes such as pre-transfer irradiation and pre-image-irradiation irradiation can be provided.

Third Embodiment

Figure 8:
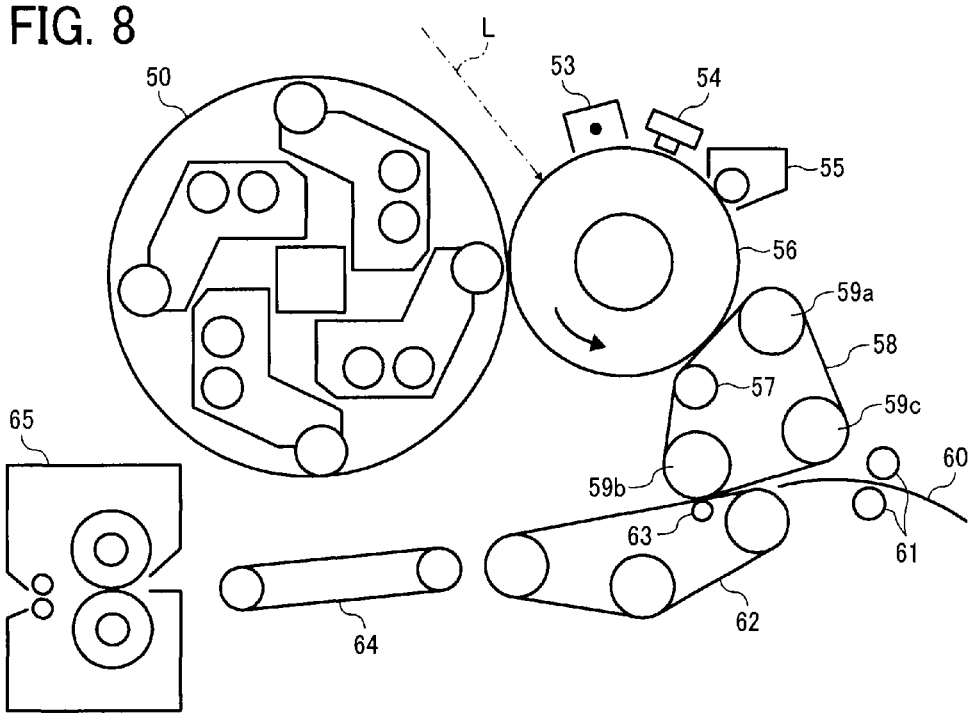
FIG. 8 is a schematic view of a full-color electrophotographic image forming apparatus according to an embodiment of the present invention.

FIG. 8 is a schematic view of a full-color electrophotographic image forming apparatus according to an embodiment of the present invention.

In the image forming apparatus illustrated in FIG. 8, a photoconductor drum 56 is driven to rotate counterclockwise. A surface of the photoconductor drum 56 is uniformly charged by a charger 53 employing corotron or scorotron, and then scanned by laser light L emitted from a laser optical device. The light scanning is performed based on single-color image information of yellow, magenta, cyan, and black. Accordingly, electrostatic latent images corresponding to yellow, magenta, cyan, and black images are formed on the photoconductor drum 56. A revolver developing unit 50 is disposed on the left side of the photoconductor drum 56 in FIG. 8. The revolver developing unit 50 contains a yellow developing device, a magenta developing device, a cyan developing device, and a black developing device in a drum-shaped housing. As the revolver developing unit 50 rotates, each developing device is sequentially carried to a developing position where each developing device faces the photoconductor drum 56. The yellow developing device, magenta developing device, cyan developing device, and black developing device develop electrostatic latent images by supplying yellow toner, magenta toner, cyan toner, and black toner, respectively.

Electrostatic latent images of yellow, magenta, cyan, and black are sequentially formed on the photoconductor drum 56. The electrostatic latent images of yellow, magenta, cyan, and black are sequentially developed into an yellow toner image, a magenta toner image, a cyan toner image, and a black toner image by each developing device contained in the revolver developing unit 50.

An intermediate transfer unit is disposed downstream from the developing position relative to the direction of rotation of the photoconductor drum 56. The intermediate transfer unit includes an intermediate transfer belt 58 that is stretched taut with a tension roller 59*a*, an intermediate transfer bias roller 57, a secondary transfer backup roller 59*b*, and a belt driving roller 59*c*. The intermediate transfer belt 58 is rotary-driven by the belt driving roller 59*c* so as to endlessly move clockwise in FIG. 8. The yellow toner image, magenta toner image, cyan toner image, and black toner image formed on the photoconductor drum 56 enter into an intermediate transfer nip where the photoconductor drum 56 is in contact with the intermediate transfer belt 58. The yellow toner image, magenta toner image, cyan toner image, and black toner image are superimposed on one another on the intermediate transfer belt 58 by the influence of a bias from the intermediate transfer bias roller 57. Thus, a four-color composite toner image is formed.

A surface of the rotating photoconductor drum 56 having passed though the intermediate transfer nip is then subject to cleaning by a drum cleaning unit 55 so that residual toner particles remaining on the surface are removed. The drum cleaning unit 55 includes a cleaning roller that removes residual toner particles upon application of a cleaning bias. Alternatively, the drum cleaning unit 55 may include a cleaning brush composed of a fur brush or a magnetic fur brush, or a cleaning blade.

The surface of the photoconductor drum 56 from which residual toner particles have been removed is then neutralized by a neutralization lamp 54. Specific examples of the neutralization lamp 54 include, but are not limited to, fluorescent lamp, tungsten lamp, halogen lamp, mercury lamp, sodium-vapor lamp, light-emitting diode (LED), laser diode (LD), and electroluminescence (EL). The layer optical device includes a laser diode as a light source. Light emitted from the light source can be filtered with any type of filter, such as sharp cut filter, band pass filter, near infrared cut filter, dichroic filter, interference filter, and color-temperature conversion filter, so that light having desired wavelengths is extracted.

On the other hand, a recording medium 60 is fed from a paper feeding cassette and sandwiched between a pair of registration rollers 61. The registration rollers 61 feed the recording medium 60 to a secondary transfer nip in synchronization with an entry of the four-color composite toner image on the intermediate transfer belt 58 thereto. The four-color composite toner image is transferred from the intermediate transfer belt 58 onto the recording medium 60 at the secondary transfer nip by the influence of a secondary transfer bias from a transfer bias roller 63. As a result of the secondary transfer, a full-color image is formed on the recording medium 60.

A transfer belt 62 conveys the recording medium 60 having the full-color image thereon to a paper conveyance belt 64. The conveyance belt 64 then conveys the recording medium 60 to a fixing device 65. The fixing device 65 conveys the recording medium 60 while sandwiching the recording medium 60 in between a heat roller and a backup roller (i.e., in a fixing nip). The full-color image is fixed on the recording medium 60 by the influence of heat from the heat roller and pressure received in the fixing nip.

Each of the transfer belt 62 and conveyance belt 64 is applied with a bias so as to adsorb the recording medium 60. Additionally, a paper neutralizing charger for neutralizing the recording medium 60 and three belt neutralizing charges for neutralizing the intermediate transfer belt 58, transfer belt 62, and conveyance belt 64 are disposed. The intermediate transfer unit further includes a belt cleaning unit having the same configuration as the drum cleaning unit 55. The belt cleaning unit removes residual toner particles remaining on the intermediate transfer belt 58.

According to the present embodiment, the electrophotographic image forming apparatus includes a transfer device and an intermediate transfer device. The transfer device primarily transfers a toner image formed on an electrophotographic photoconductor onto an intermediate transfer medium to form an image on the intermediate transfer medium, and the intermediate transfer device secondarily transfers the image formed on the intermediate transfer medium onto a recording medium.

In a case in which the image to be secondarily transferred onto the recording medium is a color image composed of multiple color toners, the transfer device sequentially superimposes the multiple color toners one another on the intermediate transfer medium to form a composite image, and the intermediate transfer device then transfers the composite image formed on the intermediate transfer medium onto the recording medium at once.

Fourth Embodiment

Figure 9:
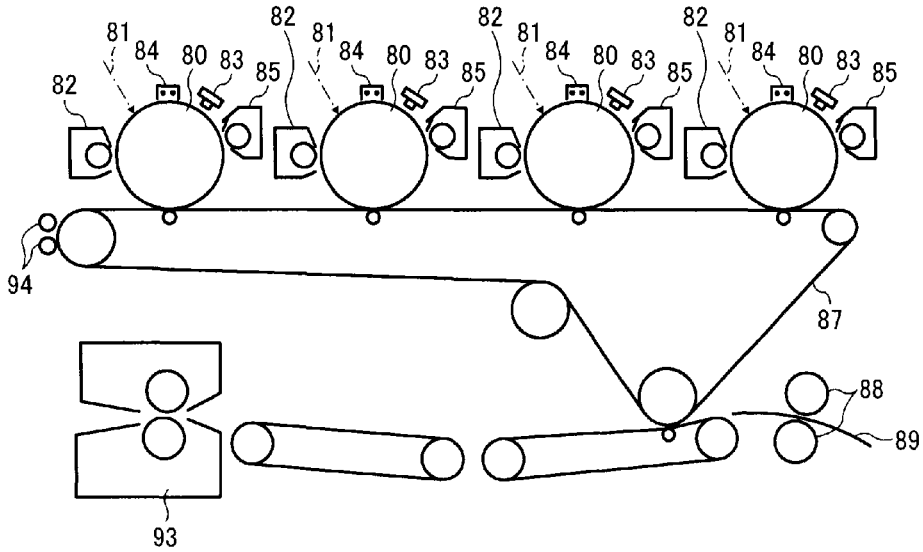
FIG. 9 is a schematic view of an image forming apparatus according to an embodiment of the present invention.

FIG. 9 is a schematic view of an image forming apparatus according to an embodiment of the present invention. The image forming apparatus illustrated in FIG. 9 is a tandem-type printer. Unlike the image forming apparatus illustrated in FIG. 8 in which a single photoconductor drum is shared, this image forming apparatus includes four photoconductor drums corresponding to cyan, magenta, yellow, and black colors. The image forming apparatus further includes four drum cleaning units 85, four neutralization lamps 83, and four chargers 84, each corresponding to cyan, magenta, yellow, and black colors. In FIG. 9, a numeral 81 denotes light irradiation by an irradiator, 82 denotes a developing device, 87 denotes an intermediate transfer belt, 98 denotes a recording medium, 88 denotes a conveyance roller, 93 denotes a fixing device, and 94 denotes an intermediate transfer belt cleaner.

In this tandem-type apparatus, the formation and development of electrostatic latent images can be performed in parallel. Thus, the image forming speed is extremely higher than that of the revolver-type apparatus.

Process Cartridge

A process cartridge in accordance with some embodiments of the present invention includes at least the above-described electrophotographic photoconductor according to an embodiment of the present invention; and at least one of a charger to charge a surface of the electrophotographic photoconductor, an irradiator to irradiate the charged surface of the electrophotographic photoconductor with light to form an electrostatic latent image thereon, a developing device to develop the electrostatic latent image into a visible image with toner, and a transfer device to transfer the visible image onto a recording medium.

Figure 10:
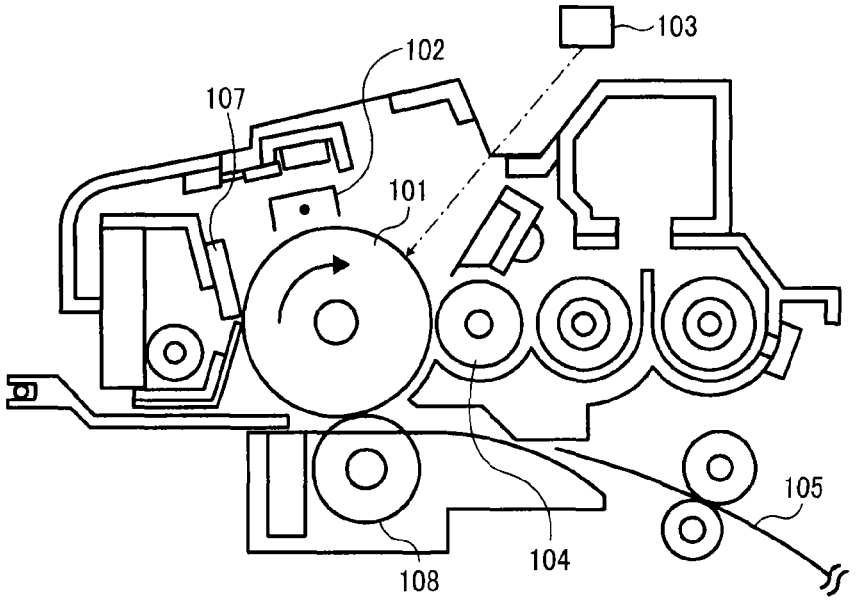
FIG. 10 is a schematic view of a process cartridge according to an embodiment of the present invention.

FIG. 10 is a schematic view of a process cartridge according to an embodiment of the present invention. This process cartridge includes an electrophotographic photoconductor 101, a charger 102, a developing device 104, a transfer device 108, a cleaner 107, and a neutralizer. The process cartridge is detachably mountable on image forming apparatus. In an image forming process, the photoconductor 101 rotates in a direction indicated by arrow in FIG. 10. A surface of the photoconductor 101 is charged by the charger 102 and irradiated with light emitted from an irradiator 103. Thus, an electrostatic latent image is formed on the surface of the photoconductor 101. The electrostatic latent image is developed into a toner image by the developing device 104. The toner image is transferred onto a recording medium 105 by the transfer device 108. The recording medium 105 having the toner image thereon is printed out. After the image transfer, the surface of the photoconductor 101 is cleaned by the cleaner 107 and neutralized by the neutralizer. These operations are repeatedly performed.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Measurement of Average Particle Diameter of Zinc Oxide Particles

The average particle diameter of the zinc oxide particles are determined by observing 100 randomly-selected particles in the undercoat layer with a transmission electron microscope (TEM), measuring the projected areas of the particles, calculating circle-equivalent diameters of the projected areas, and averaging them.

Example 1

Preparation of Undercoat Layer Coating Liquid

Preparation of Surface-Treated Zinc Oxide Particles

The below-listed materials are stirred for 2 hours. The mixture is subjected to distillation under reduced pressures to remove toluene, and then burned at 120° C. for 3 hours. Thus, surface-treated zinc oxide particles are prepared.

| | |
|---|---|
| Zinc oxide particles: Zinc oxide having an average particle diameter of 100 nm (prepared by the above-described wet method) | 100 parts |
| Surface treatment agent: Silane coupling agent (N-2-(aminoethyl)-3-aminopropyl trimethoxysilane, KBM 603 from Shin-Etsu Chemical Co., Ltd.) | 2 parts |
| Solvent: Tetrahydrofuran | 500 parts |

The below-listed materials are stirred by a vibration mill filled with zirconia beads having a diameter of 0.5 mm for 3 hours to prepare an undercoat layer coating liquid.

| | |
|---|---|
| Surface-treated zinc oxide particles prepared above | 300 parts |
| Binder resins | |
| Blocked isocyanate (having 75% by mass of solid contents, SUMIDUR ® 3175 from Sumika Bayer Urethane Co., Ltd.) | 60 parts |
| 20% 2-Butanone-diluted solution of a butyral resin (BX-1 from Sekisui Chemical Co., Ltd.) | 225 parts |
| Solvent: 2-Butanone | 105 parts |

The mass ratio (F/R) of the zinc oxide particles (F) to the binder resins (R) is $300/(60\times0.75+225\times0.2)=3.3$.

Preparation of Charge Generation Layer Coating Liquid

The below-listed materials are stirred by a bead mill filled glass beads having a diameter of 1 mm for 8 hours to prepare a charge generation layer coating liquid.

Figure 11:
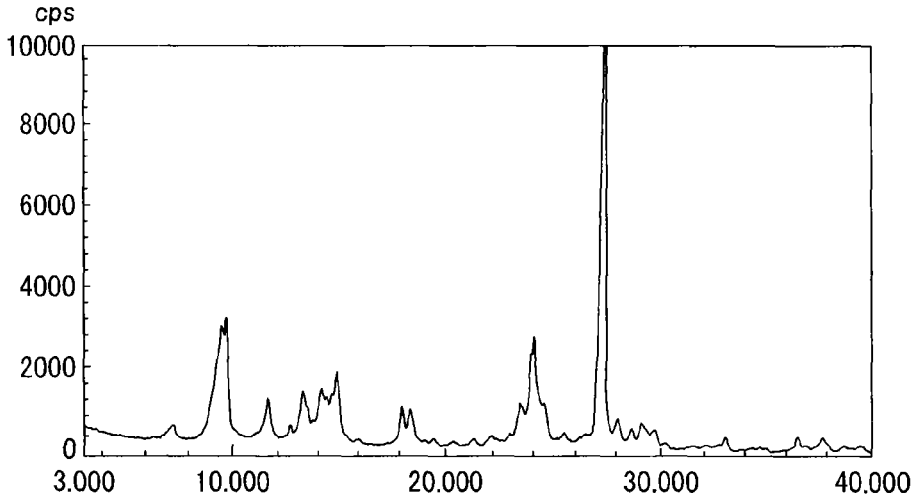
FIG. 11 is a powder X-ray diffraction spectrum of a titanyl phthalocyanine used in Examples.

| | |
|---|---|
| Charge generation material: Titanyl phthalocyanine (A powder X-ray diffraction spectrum of the titanyl phthalocyanine is shown in FIG. 11.) | 8 parts |
| Binder resin: Polyvinyl butyral (S-LEC BX-1 from Sekisui Chemical Co., Ltd.) | 5 parts |
| Solvent: 2-Butanone | 400 parts |

Preparation of Charge Transport Layer Coating Liquid

The below-listed materials are mixed and stirred until all the materials are dissolved to prepare a charge transport layer coating liquid.

| | |
|---|---|
| Charge transport material having the formula (1) | 7 parts |

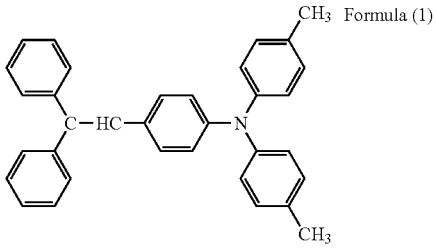

Formula (1)

| | |
|---|---|
| Binder resin: Polycarbonate (TS-2050 from Teijin Chemicals Ltd.) | 10 parts |
| Leveling agent: Silicone oil (KF-50 from Shin-Etsu Chemical Co., Ltd.) | 0.0005 parts |
| Solvent: Tetrahydrofuran | 100 parts |

Preparation of Electrophotographic Photoconductor

The undercoat layer coating liquid is applied to an aluminum cylinder having a diameter of 100 mm and a length of 380 mm by a dipping method and dried at 170° C. for 30 minutes. Thus, an undercoat layer having an average thickness of 14 μm is formed.

Next, the charge generation layer coating liquid is applied to the undercoat layer by a dipping method and dried at 90° C. for 30 minutes. Thus, a charge generation layer having an average thickness of 0.2 μm is formed.

Next, the charge transport layer coating liquid is applied to the charge generation layer by a dipping method and dried at 150° C. for 30 minutes. Thus, a charge transport layer having an average thickness of 25 μm is formed. An electrophotographic photoconductor of Example 1 is prepared in the above manner.

An undercoat layer sample is prepared by forming the undercoat layer on the aluminum cylinder in the same manner as above. A charge transport layer sample is prepared by forming the charge transport layer on the aluminum cylinder in the same manner as above.

These samples are subjected to a measurement of capacitance ($C_{UL}$ and $C_{CTL}$) of the undercoat layer and charge transport layer, respectively, with an impedance analyzer (Model 1260 from Solartron Analytical). As a result, $C_{UL}$ is 550 pF/cm$^2$ and $C_{CTL}$ is 103 pF/cm$^2$. The distribution voltage $V_{UL}$ distributed to the undercoat layer is determined by plugging in these values into the equation (4). As a result, when the charged potential $V_{OPC}$ is 600V, $V_{UL}$ is 95 V.

$$V_{UL}=V_{OPC}\cdot C_{CTL}/(C_{UL}+C_{CTL}) \quad (4)$$

The sample prepared by forming the undercoat layer on the aluminum cylinder is further subjected to a measurement of a voltage (V)-current (I) characteristics with a micro current meter (Model 8340A from Advantest Corporation). With respect to the V-I characteristics of the undercoat layer, S1 is obtained by integrating I in terms of V from 0 to $V_{UL}$, and S2 is obtained by integrating a line connecting two points at V of 0 and $V_{UL}$ in terms of V from 0 to $V_{UL}$. As a result, S1 is $3.7\times10^4$ and a ratio (S1/S2) is 0.36.

Example 2

Preparation of Electrophotographic Photoconductor

The procedure in Example 1 is repeated except that the amount of the surface-treated zinc oxide particles in the undercoat layer coating liquid is changed to 400 parts (F/R=4.4), and the method of forming the undercoat layer coating liquid is changed such that the surface-treated zinc oxide particles, binder resins, and solvent are mixed and stirred by a vibration mill filled with zirconia beads having a diameter of 0.5 mm for 4 hours, and the average thickness of the undercoat layer is changed to 13 μm.

The resulting electrophotographic photoconductor is subjected to measurements of the distribution voltage ($V_{UL}$), V-I characteristics, S1, and S2 in the same manner as in Example 1. As a result, S1 is $1.6\times10^{-3}$ and a ratio (S1/S2) is 0.42.

Example 3

The procedure in Example 1 is repeated except that the amount of the surface-treated zinc oxide particles in the undercoat layer coating liquid is changed to 450 parts (F/R=5.0).

The resulting electrophotographic photoconductor is subjected to measurements of the distribution voltage ($V_{UL}$), V-I characteristics, S1, and S2 in the same manner as in Example 1. As a result, S1 is $6.2\times10^{-3}$ and a ratio (S1/S2) is 0.42.

Example 4

The procedure in Example 1 is repeated except that the amount of the surface-treated zinc oxide particles in the undercoat layer coating liquid is changed to 250 parts (F/R=2.8), and the method of forming the undercoat layer coating liquid is changed such that the surface-treated zinc oxide particles, binder resins, and solvent are mixed and stirred by a sand mill filled with zirconia beads having a diameter of 0.5 mm for 4 hours.

The resulting electrophotographic photoconductor is subjected to measurements of the distribution voltage ($V_{UL}$), V-I characteristics, S1, and S2 in the same manner as in Example 1. As a result, S1 is $2.8\times-10^4$ and a ratio (S1/S2) is 0.35.

Example 5

The procedure in Example 1 is repeated except that the amount of the surface-treated zinc oxide particles in the undercoat layer coating liquid is changed to 500 parts (F/R=5.6).

The resulting electrophotographic photoconductor is subjected to measurements of the distribution voltage ($V_{UL}$), V-I characteristics, S1, and S2 in the same manner as in Example 1. As a result, S1 is $8.5\times10^{-3}$ and a ratio (S1/S2) is 0.45.

Example 6

The procedure in Example 4 is repeated except that the surface-treated zinc oxide particles in the undercoat layer coating liquid are replaced with those having an average particle diameter of 25 nm (prepared by the above-described wet method).

The resulting electrophotographic photoconductor is subjected to measurements of the distribution voltage ($V_{UL}$), V-I characteristics, S1, and S2 in the same manner as in Example 1. As a result, S1 is $3.9\times10^{-3}$ and a ratio (S1/S2) is 0.43.

Example 7

The procedure in Example 4 is repeated except that the surface-treated zinc oxide particles in the undercoat layer coating liquid are replaced with those having an average particle diameter of 200 nm (prepared by the above-described wet method), and the average thickness of the undercoat layer is changed to 13 μm.

The resulting electrophotographic photoconductor is subjected to measurements of the distribution voltage ($V_{UL}$), V-I characteristics, S1, and S2 in the same manner as in Example 1. As a result, S1 is $1.9\times10^{-4}$ and a ratio (S1/S2) is 0.35.

Example 8

The procedure in Example 4 is repeated except that the surface-treated zinc oxide particles in the undercoat layer coating liquid are replaced with those having an average particle diameter of 15 nm (prepared by the above-described wet method).

The resulting electrophotographic photoconductor is subjected to measurements of the distribution voltage ($V_{UL}$), V-I characteristics, S1, and S2 in the same manner as in Example 1. As a result, S1 is $9.6\times10^{-3}$ and a ratio (S1/S2) is 0.47.

Example 9

The procedure in Example 4 is repeated except that the surface-treated zinc oxide particles in the undercoat layer coating liquid are replaced with those having an average particle diameter of 250 nm (prepared by the above-described wet method).

The resulting electrophotographic photoconductor is subjected to measurements of the distribution voltage ($V_{UL}$), V-I characteristics, S1, and S2 in the same manner as in Example 1. As a result, S1 is $5.5\times10^{-4}$ and a ratio (S1/S2) is 0.34.

Example 10

The procedure in Example 9 is repeated except that the surface-treated zinc oxide particles in the undercoat layer coating liquid are replaced with zinc oxide particles without surface treatment (prepared by the above-described wet method).

The resulting electrophotographic photoconductor is subjected to measurements of the distribution voltage ($V_{UL}$), V-I characteristics, S1, and S2 in the same manner as in Example 1. As a result, S1 is $5.5\times10^{-4}$ and a ratio (S1/S2) is 0.30.

Example 11

The procedure in Example 10 is repeated except that the surface-treated zinc oxide particles in the undercoat layer coating liquid are replaced with those having an average particle diameter of 15 nm (prepared by the above-described wet method), and the method of forming the undercoat layer coating liquid is changed such that the surface-treated zinc oxide particles, binder resins, and solvent are mixed and stirred by a sand mill filled with zirconia beads having a diameter of 0.5 mm for 6 hours.

The resulting electrophotographic photoconductor is subjected to measurements of the distribution voltage ($V_{UL}$), V-I characteristics, S1, and S2 in the same manner as in Example 1. As a result, S1 is $9.0\times10^{-3}$ and a ratio (S1/S2) is 0.45.

Example 12

The procedure in Example 10 is repeated except that the method of forming the undercoat layer coating liquid is changed such that the surface-treated zinc oxide particles, binder resins, and solvent are mixed and stirred by a sand mill filled with zirconia beads having a diameter of 0.5 mm for 3 hours.

The resulting electrophotographic photoconductor is subjected to measurements of the distribution voltage ($V_{UL}$), V-I characteristics, S1, and S2 in the same manner as in Example 1. As a result, S1 is $1.8\times10^{-4}$ and a ratio (S1/S2) is 0.35.

Comparative Example 1

The procedure in Example 4 is repeated except that the surface-treated zinc oxide particles in the undercoat layer coating liquid are replaced with those having an average particle diameter of 300 nm (prepared by the above-described wet method), and the average thickness of the undercoat layer is changed to 13 μm.

The resulting electrophotographic photoconductor is subjected to measurements of the distribution voltage ($V_{UL}$), V-I characteristics, S1, and S2 in the same manner as in Example 1. As a result, S1 is $8.5\times10^{-5}$ and a ratio (S1/S2) is 0.34.

Comparative Example 2

The procedure in Example 8 is repeated except that the amount of the surface-treated zinc oxide particles in the undercoat layer coating liquid is changed to 600 parts (F/R=6.7).

The resulting electrophotographic photoconductor is subjected to measurements of the distribution voltage ($V_{UL}$), V-I characteristics, S1, and S2 in the same manner as in Example 1. As a result, S1 is $1.4\times10^{-2}$ and a ratio (S1/S2) is 0.49.

Comparative Example 3

The procedure in Example 8 is repeated except that the amount of the surface-treated zinc oxide particles in the undercoat layer coating liquid is changed to 550 parts (F/R=6.1.), and the average thickness of the undercoat layer is changed to 13 μm.

The resulting electrophotographic photoconductor is subjected to measurements of the distribution voltage ($V_{UL}$), V-I characteristics, S1, and S2 in the same manner as in Example 1. As a result, S1 is $8.0\times10^{-3}$ and a ratio (S1/S2) is 0.55.

Comparative Example 4

The procedure in Comparative Example 2 is repeated except that the method of forming the undercoat layer coating liquid is changed such that the surface-treated zinc oxide particles, binder resins, and solvent are mixed and stirred by a vibration mill filled with zirconia beads having a diameter of 0.5 mm for 2 hours.

The resulting electrophotographic photoconductor is subjected to measurements of the distribution voltage ($V_{UL}$), V-I characteristics, S1, and S2 in the same manner as in Example 1. As a result, S1 is $2.5\times10^{-2}$ and a ratio (S1/S2) is 0.56.

Comparative Example 5

The procedure in Example 1 is repeated except that the method of forming the undercoat layer coating liquid is changed such that the surface-treated zinc oxide particles, binder resins, and solvent are mixed and stirred by a sand mill filled with glass beads having a diameter of 1.0 mm for 2 hours, and the average thickness of the undercoat layer is changed to 15 μm.

The resulting electrophotographic photoconductor is subjected to measurements of the distribution voltage ($V_{UL}$), V-I characteristics, S1, and S2 in the same manner as in Example 1. As a result, S1 is $2.5\times10^{-2}$ and a ratio (S1/S2) is 0.52.

Comparative Example 6

The procedure in Example 1 is repeated except that the method of forming the undercoat layer coating liquid is changed such that the surface-treated zinc oxide particles, binder resins, and solvent are mixed and stirred by a vibration mill filled with glass beads having a diameter of 1.0 mm for 10 hours, and the average thickness of the undercoat layer is changed to 15 μm.

The resulting electrophotographic photoconductor is subjected to measurements of the distribution voltage ($V_{UL}$), V-I characteristics, S1, and S2 in the same manner as in Example 1. As a result, S1 is $8.0\times10^{-5}$ and a ratio (S1/S2) is 0.61.

In Examples 1 to 12 and Comparative Examples 1 to 6, the undercoat layer formed on the aluminum cylinder is subjected to a measurement of V-I characteristics and determination of S1 and S2 before the photosensitive layers (charge generation layer, charge generation layer) are formed thereon. In addition, the undercoat layer revealed by detaching the photosensitive layers (charge generation layer, charge generation layer) having been formed thereon is also subjected to a measurement of V-I characteristics and determination of S1 and S2. The resulting S1 and S2 values are same as those measured after formation of the undercoat layer but before the photosensitive layers.

The results are shown in Table 1.

The electrophotographic photoconductors prepared in Examples and Comparative Examples are evaluated as follows. The results are shown in Table 2.

Image Forming Apparatus Used for Evaluations

A modified digital copier (RICOH Pro C900 from Ricoh Co., Ltd.) is used as an evaluation apparatus. The charger employs a scorotron charger (equipped with a discharge wire having a diameter of 50 μm made of gold-plated tungsten-molybdenum alloy). The light source for irradiating light containing image information employs LD light having a wavelength of 780 nm (images are written by polygon mirror and the resolution is 1,200 dpi). The developing device employs a two-component developing method using black toner. The transfer device employs a transfer belt. The neutralizer employs a neutralization lamp.

Deterioration of Photoconductor

To cause each electrophotographic photoconductor to deteriorate, a black single-color test chart (having an image area ratio of 5%) are continuously output on 250,000 sheets under a normal-temperature and normal-humidity condition of 23° C., 55% RH.

Measurement of Charging Characteristics and Optical Attenuation Characteristics

Each photoconductor is subjected to a measurement of surface potential before and after the above deterioration procedure. Surface potential is measured with the evaluation apparatus (RICOH Pro C900 from Ricoh Co., Ltd.), on which a potential sensor obtained by modifying the developing unit of the evaluation apparatus (RICOH Pro C900 from Ricoh Co., Ltd.) is mounted, in the following manner.

While setting the amount of current applied to the discharge wire to −1,800 μA and the grid voltage to −600 V, a solid image is continuously formed on 10 sheets of A3-size paper in a longitudinal direction. The 10th sheet is subjected to a measurement of charged potential (VD) and post-irradiation potential (VL). The charging characteristics and optical attenuation characteristic are evaluated based on the following criteria. The charged potential (VD) and post-irradiation potential (VL) are measured with a surface potentiometer (Model 244A from Monroe Electronics, Inc.) and a probe (Model 1017A from Monroe Electronics, Inc.). Surface potential values are recorded by an oscilloscope at 100 signal/sec or more.

Evaluation Criteria for Charging Characteristics

A: The difference in charged potential (ΔVD) before and after the deterioration of photoconductor is less than 10 V.

B: The difference in charged potential (ΔVD) before and after the deterioration of photoconductor is not less than 10 V and less than 20 V.

C: The difference in charged potential (ΔVD) before and after the deterioration of photoconductor is not less than 20 V and less than 30 V.

D: The difference in charged potential (ΔVD) before and after the deterioration of photoconductor is not less than 30 V.

Evaluation Criteria for Optical Attenuation Characteristics (Residual Potential)

A: The difference in post-irradiation potential (ΔVL) before and after the deterioration of photoconductor is less than 10 V.

B: The difference in post-irradiation potential (ΔVL) before and after the deterioration of photoconductor is not less than 10 V and less than 20 V.

C: The difference in post-irradiation potential (ΔVL) before and after the deterioration of photoconductor is not less than 20 V and less than 30 V.

D: The difference in post-irradiation potential (ΔVL) before and after the deterioration of photoconductor is not less than 30 V.

Image Evaluation

Images are output before and after the deterioration of photoconductor and subjected to evaluations in terms of residual image and background fog.

Whether residual image is generated or not is determined by continuously outputting an x-shaped pattern with a size of 3 cm×3 cm on 3 sheets, then continuously outputting a halftone image on 3 sheets, and visually observing the images.

Whether background fog is generated or not is determined by continuously outputting white solid image on 5 sheets or gloss-coated paper, and visually observing the images.

TABLE 1

| | Average Particle Diameter of Zinc Oxide Partices (nm) | F/R | Average Thickness of Undercoat Layer (μm) | S1 | S1/S2 |
|---|---|---|---|---|---|
| Example 1 | 100 | 3.3 | 14 | $3.7\times10^{-4}$ | 0.36 |
| Example 2 | 100 | 4.4 | 13 | $1.6\times10^{-3}$ | 0.42 |
| Example 3 | 100 | 5.0 | 14 | $6.2\times10^{-3}$ | 0.42 |
| Example 4 | 100 | 2.8 | 14 | $2.8\times10^{-4}$ | 0.35 |
| Example 5 | 100 | 5.6 | 14 | $8.5\times10^{-3}$ | 0.45 |
| Example 6 | 25 | 2.8 | 14 | $3.9\times10^{-3}$ | 0.43 |
| Example 7 | 200 | 2.8 | 13 | $1.9\times10^{-4}$ | 0.35 |

TABLE 1-continued

| | Average Particle Diameter of Zinc Oxide Partices (nm) | F/R | Average Thickness of Undercoat Layer (μm) | S1 | S1/S2 |
|---|---|---|---|---|---|
| Example 8 | 15 | 2.8 | 14 | $9.6 \times 10^{-3}$ | 0.47 |
| Example 9 | 250 | 2.8 | 14 | $5.5 \times 10^{-4}$ | 0.34 |
| Example 10 | 250 | 2.8 | 14 | $1.5 \times 10^{-4}$ | 0.30 |
| Example 11 | 15 | 2.8 | 15 | $9.0 \times 10^{-3}$ | 0.45 |
| Example 12 | 250 | 2.8 | 14 | $1.8 \times 10^{-4}$ | 0.35 |
| Comparative Example 1 | 300 | 2.8 | 13 | $8.5 \times 10^{-5}$ | 0.34 |
| Comparative Example 2 | 15 | 6.7 | 14 | $1.4 \times 10^{-2}$ | 0.49 |
| Comparative Example 3 | 15 | 6.1 | 13 | $8.0 \times 10^{-3}$ | 0.55 |
| Comparative Example 4 | 15 | 6.7 | 14 | $2.5 \times 10^{-2}$ | 0.56 |
| Comparative Example 5 | 100 | 3.3 | 15 | $2.0 \times 10^{-2}$ | 0.52 |
| Comparative Example 6 | 100 | 3.3 | 15 | $8.0 \times 10^{-5}$ | 0.61 |

TABLE 2

| | Charged Potential (V) | Distribution Voltage to Undercoat Layer VUL (V) | ΔVD | ΔVL | Image Evaluation |
|---|---|---|---|---|---|
| Example 1 | 600 | 95 | A | A | Very good |
| Example 2 | 600 | 98 | A | A | Very good |
| Example 3 | 600 | 100 | A | A | Very good |
| Example 4 | 600 | 80 | A | B | Good |
| Example 5 | 600 | 105 | B | A | Good |
| Example 6 | 600 | 130 | A | B | Good |
| Example 7 | 600 | 65 | A | B | Good |
| Example 8 | 600 | 145 | B | B | Good |
| Example 9 | 600 | 55 | A | C | Good |
| Example 10 | 600 | 60 | A | C | Good |
| Example 11 | 600 | 160 | C | B | Good |
| Example 12 | 600 | 40 | B | C | Good |
| Comparative Example 1 | 600 | 30 | B | D | Residual image |
| Comparative Example 2 | 600 | 155 | D | B | Background fog |
| Comparative Example 3 | 600 | 130 | D | B | Background fog |
| Comparative Example 4 | 600 | 160 | D | B | Background fog |
| Comparative Example 5 | 600 | 85 | D | B | Background fog |
| Comparative Example 6 | 600 | 95 | B | D | Residual image |

What is claimed is:

1. An electrophotographic photoconductor, comprising:

a conductive support having a volume resistivity of $1\times10^{10}$ Ω·cm or less;

an undercoat layer overlying the support, the undercoat layer having an average thickness of not less than 0.5 μm and less than 15 μm and comprising:

zinc oxide particles having an average particle diameter of from 20 to 200 nm; and a binder resin, wherein a mass ratio (F/R) of the zinc oxide particles (F) to the binder resin (R) is from 1/1 to 6/1; and a photosensitive layer comprising at least one of a phthalocyanine pigment and an azo pigment overlying the undercoat layer, wherein the undercoat layer has a voltage (V)-current (I) characteristics such that S1 is within a range of from $1.0\times10^{-4}$ to $1.0\times10^{-2}$ and a ratio (S1/S2) of S1 to S2 is 0.50 or less, where S1 is a value obtained by integrating current (I [A]) in terms of voltage (V [V]) from 0 to a distribution voltage $V_{UL}$ [V] distributed to the undercoat layer, and S2 is a value obtained by integrating a line connecting two points at a voltage (V [V]) of 0 and the distribution voltage $V_{UL}$ [V] in terms of voltage (V [V]) from 0 to the distribution voltage $V_{UL}$ [V].

2. The electrophotographic photoconductor according to claim 1, wherein the distribution voltage $V_{UL}$ [V] distributed to the undercoat layer is from 50 to 150 V.

3. The electrophotographic photoconductor according to claim 1, wherein the zinc oxide particles include surface-treated zinc oxide particles.

4. The electrophotographic photoconductor according to claim 1, wherein the zinc oxide particles have an average particle diameter of from 50 to 150 nm.

5. The electrophotographic photoconductor according to claim 1, wherein a mass ratio (F/R) of the zinc oxide particles (F) to the binder resin (R) is from 3/1 to 5/1.

6. An image forming apparatus, comprising:

the electrophotographic photoconductor according to claim 1;

a charger to charge a surface of the electrophotographic photoconductor;

an irradiator to irradiate the charged surface of the electrophotographic photoconductor with light to form an electrostatic latent image thereon;

a developing device to develop the electrostatic latent image into a visible image with toner; and a transfer device to transfer the visible image onto a recording medium.

7. A process cartridge detachably mountable on image forming apparatus, comprising:

the electrophotographic photoconductor according to claim 1; and at least one of a charger to charge a surface of the electrophotographic photoconductor, an irradiator to irradiate the charged surface of the electrophotographic photoconductor with light to form an electrostatic latent image thereon, a developing device to develop the electrostatic latent image into a visible image with toner, and a transfer device to transfer the visible image onto a recording medium.

8. The electrophotographic photoconductor according to claim 1, wherein the zinc oxide particles have a volume resistivity of from $10^2$ to $10^{13}$ Ω·m.

9. The electrophotographic photoconductor according to claim 1, wherein the binder resin comprises at least one of a water-soluble resin, an alcohol-soluble resin, and a curable resin.

10. The electrophotographic photoconductor according to claim 1, wherein the photosensitive layer comprises a charge generation layer and a charge transport layer.

11. The electrophotographic photoconductor according to claim 1, wherein S1 is within a range of from $5.5\times10^{-4}$ to $9.0\times10^{-3}$.

12. The electrophotographic photoconductor according to claim 1, wherein the ratio (S1/S2) of S1 to S2 is 0.45 or less.

13. The electrophotographic photoconductor according to claim 11, wherein the ratio (S1/S2) of S1 to S2 is 0.45 or less.

14. The electrophotographic photoconductor according to claim 1, wherein, the undercoat layer has an average thickness of not less than 0.5 μm and less than 14 μm.

15. The electrophotographic photoconductor according to claim 1, wherein, the undercoat layer has an average thickness of not less than 0.5 μm and less than 13 μm.

* * * * *